US010054320B2

(12) United States Patent
Choi et al.

(10) Patent No.: US 10,054,320 B2
(45) Date of Patent: Aug. 21, 2018

(54) INDOOR DEVICE OF AIR CONDITIONER

(71) Applicant: LG ELECTRONICS INC., Seoul (KR)

(72) Inventors: Byeonggeol Choi, Seoul (KR); Jongwook Park, Seoul (KR); Youngjoong Kim, Seoul (KR); Joseph Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 53 days.

(21) Appl. No.: 15/223,201

(22) Filed: Jul. 29, 2016

(65) Prior Publication Data

US 2017/0030595 A1 Feb. 2, 2017

(30) Foreign Application Priority Data

Jul. 30, 2015 (KR) ..... 10-2015-0107836
Jul. 31, 2015 (KR) ..... 10-2015-0109175
Aug. 12, 2015 (KR) ..... 10-2015-0113572

(51) Int. Cl.
*F24F 1/00* (2011.01)
*F24F 13/24* (2006.01)
(Continued)

(52) U.S. Cl.
CPC ..... *F24F 1/0007* (2013.01); *F24F 1/0014* (2013.01); *F24F 11/89* (2018.01);
(Continued)

(58) Field of Classification Search
CPC .. F24F 13/20; F24F 13/23; F24F 13/22; F24F 1/0014; F24F 13/24; F24F 13/222;
(Continued)

(56) References Cited

U.S. PATENT DOCUMENTS

2009/0007580 A1* 1/2009 Sakashita ..... F24F 13/222 62/259.1
2009/0025414 A1* 1/2009 Koga ..... F24F 1/0007 62/263
2014/0374075 A1* 12/2014 Michitsuji ..... F24F 1/0014 165/157

FOREIGN PATENT DOCUMENTS

EP 0 926 451 6/1999
JP 11044433 2/1999
(Continued)

OTHER PUBLICATIONS

Korean Office Action dated May 25, 2016.
(Continued)

*Primary Examiner* — Mohammad M Ali
(74) *Attorney, Agent, or Firm* — KED & Associates LLP

(57) ABSTRACT

An indoor unit or device of an air conditioner is provided that may include an outer plate configured to form an exterior of a cabinet configured to be installed at a ceiling of an indoor space; an inner case accommodated inside of the outer plate, and configured to form an internal space of the cabinet; a fan provided inside of the inner case; a heat exchanger provided to cover an outer side of the fan; a panel configured to shield the cabinet, and having an inlet port through which indoor air may be suctioned in and a panel outlet port through which heat-exchanged air may be discharged; and a drain pan assembly seated on an upper end of the inner case, and configured to collect condensate generated from the heat exchanger. An extension that extends to an open end of the outer plate may be formed at a side surface of the inner case corresponding to the panel outlet port, and a recess, which may be recessed in a shape corresponding to the panel outlet port, may be formed at an outer end of the drain pan assembly. Both ends of the extension may be in contact with an inner side surface of the
(Continued)

recess, and form an outlet port which is in communication with the panel outlet port.

20 Claims, 22 Drawing Sheets

(51) Int. Cl.
*F24F 13/22* (2006.01)
*F24F 11/02* (2006.01)
*F24F 13/20* (2006.01)
*F24F 11/89* (2018.01)

(52) U.S. Cl.
CPC ..... *F24F 13/20* (2013.01); *F24F 13/22* (2013.01); *F24F 13/222* (2013.01); *F24F 13/24* (2013.01); *F24F 2001/0037* (2013.01); *F24F 2001/0074* (2013.01); *F24F 2013/227* (2013.01); *F24F 2013/242* (2013.01)

(58) Field of Classification Search
CPC .. F24F 11/02; F24F 1/0007; F24F 2001/0037; F24F 2001/0074; F24F 2013/227; F24F 2013/242
USPC ..... 62/263
See application file for complete search history.

(56) References Cited

FOREIGN PATENT DOCUMENTS

| | | |
|---|---|---|
| JP | 2001-059630 | 3/2001 |
| JP | 2004-92997 | 3/2004 |
| JP | 2013-164202 | 8/2013 |
| KR | 10-2005-0113319 | 2/2005 |
| KR | 10-2008-0043632 | 5/2008 |
| KR | 10-2009-0011379 | 2/2009 |
| KR | 10-2014-0079108 | 6/2014 |
| KR | 10-2009-0074374 | 7/2014 |

OTHER PUBLICATIONS

Korean Office Action dated May 27, 2016.
Korean Office Action dated Nov. 2, 2016.
European Search Report dated Dec. 9, 2016.
Korean Notice of Allowance dated Dec. 19, 2016.

* cited by examiner

INDOOR DEVICE OF AIR CONDITIONER

CROSS-REFERENCE TO RELATED APPLICATIONS(S)

The application claims priority under 35 U.S.C. § 119 and 35 U.S.C. § 365 to Korean Patent Application No. 10-2015-0107836 filed in Korea on Jul. 30, 2015 and 10-2015-0109175 filed Jul. 31, 2015 and 10-2015-0113572 filed in Korea on Aug. 12, 2015, whose entire disclosure is hereby incorporated by reference.

BACKGROUND

1. Field

An indoor device of an air conditioner is disclosed herein.

2. Background

Generally, an air conditioner is a cooling and heating system that heats and cools a room by repeatedly suctioning in indoor air, exchanging heat with a low temperature or high temperature refrigerant, and then discharging the heat-exchanged air into the room, and also an apparatus that forms a series of cycles including a compressor, a condenser, an expansion valve, and an evaporator. In particular, the air conditioner is divided into an outdoor unit or device, which may be referred to as an 'outdoor side' or 'heat radiating side', which is mainly installed at an outside of a building, and an indoor unit or device, which may be referred to as an 'indoor side' or 'heat absorbing side', which is mainly installed at an inside of a building. The condenser (an outdoor heat exchanger) and the compressor are installed at the outdoor device, and the evaporator (an indoor heat exchanger) is installed at the indoor device.

The air conditioner may be classified into a separate type air conditioner in which the outdoor device and the indoor device are separately installed, and an integral type air conditioner, in which the outdoor device and the indoor device are integrally installed. The separate type air conditioner is preferred in consideration of an installation space and noise, for example.

In a multi-type air conditioner among the separate type air conditioners, a plurality of indoor units or devices is connected to one outdoor unit or device, and the devices is are installed at rooms to be air-conditioned, respectively, and thus, an effect as if several air conditioners are installed may be obtained. As an indoor device of such a multi-type air conditioner, an indoor device of a cassette type air conditioner, which is installed at a ceiling of an indoor space and heats and cools the indoor space is widely used.

A representative configuration of the cassette type air conditioner is disclosed in Korean Patent Publication No. 10-2009-0074374, which is hereby incorporated by reference. In Korean Patent Publication No. 10-2009-0074374, there is disclosed a drain pan which is coupled to a case provided inside of a cabinet installed at the ceiling and has a panel outlet port. The panel outlet port is formed by opening an outside of the drain pan, and an upper end of the case is in contact with an external lower end of the drain pan when the drain pan is installed.

Therefore, when air is discharged through the panel outlet port, a portion at which the external lower end of the drain pan is in contact with the upper end of the case is exposed to a route along which the air flows. When the air flows toward a joining portion, vibration and shaking may be generated, and thus, noise may also be generated. Also, an outer surface of the drain pan is formed to be thin due to formation of the panel outlet port, and thus, may be damaged during an assembling process or due to vibration, for example, when the air flows.

There is also disclosed a structure in which the drain pan for shielding an entire inside of the cabinet except an inlet port and an outlet port is provided, and a control box is provided at one side of the drain pan. A wire connection between the control box and elements, such as a fan and a fan motor, is required to drive the elements. When an arrangement of a wire is not appropriate, it is difficult to perform an installing and assembling operation, and vibration noise, for example, may be generated.

In FIGS. 1 and 2 of Korean Patent Publication No. 10-2014-079108, which is hereby incorporated by reference, there is disclosed a structure in which a condensate pump that pumps and discharges condensate to an outside is provided inside of a main body installed at a ceiling, and a mount portion protrudes inward from an inside of the main body and then extends so as to have a predetermined height, such that an entrance end of the condensate pump is in contact with a drain. However, in such a structure, the mount portion has a structure which protrudes to an inner space of the main body by a cross-sectional area corresponding to an area of a lower surface of the condensate pump to support the condensate pump. Therefore, when the air flows by the fan, the air that flows along a wall surface inside of the main body collides with the mount portion, and thus, a reduction in a flow rate and generation of noise occur due to an increase in a passage resistance.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described in detail with reference to the accompanying drawings. The embodiments may, however, be embodied in many different forms and should not be construed as being limited to the embodiments set forth herein; rather, alternative embodiments included in other retrogressive inventions or falling within the spirit and scope can easily be derived through adding, altering, and removing, and will fully convey the concept to those skilled in the art.

Figure 1:
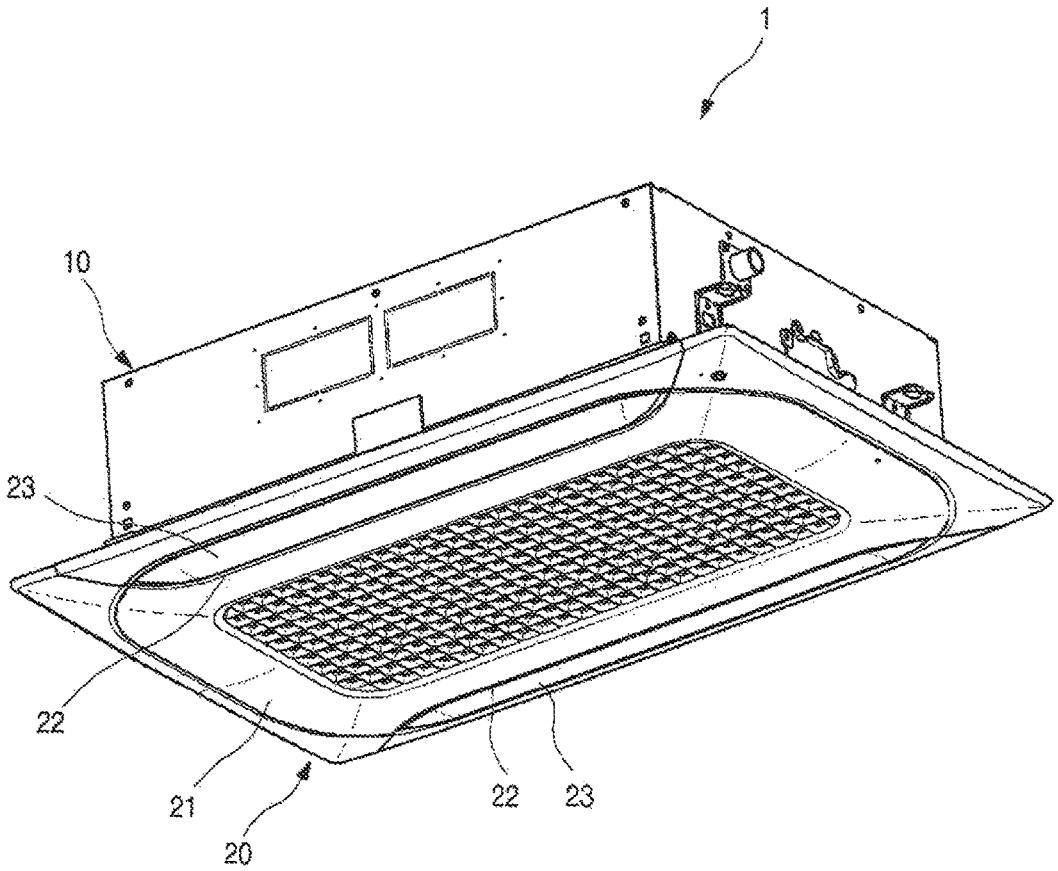
FIG. 1 is a perspective view of an indoor unit or device of an air conditioner according to an embodiment.
Figure 2:
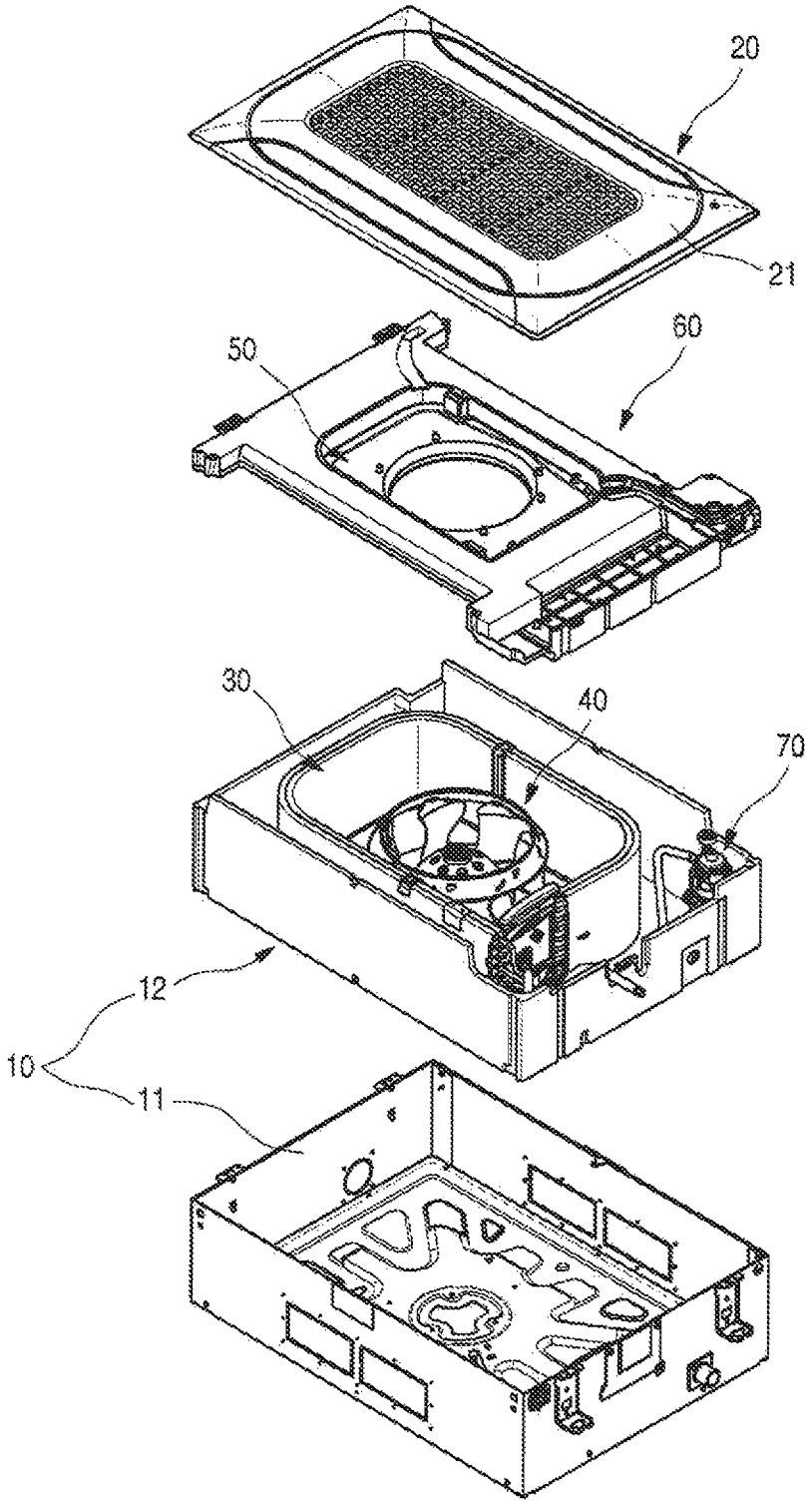
FIG. 2 is an exploded perspective view of the indoor device of FIG. 1.

FIG. 1 is a perspective view of an indoor unit or device of an air conditioner according to an embodiment. FIG. 2 is an exploded perspective view of the indoor device of FIG. 1.

As illustrated in the drawings, an indoor unit or device 1 of an air conditioner (hereinafter, referred to as an "indoor unit" or "indoor device") according to an embodiment may generally include a cabinet 10, which may be inserted into a ceiling of an indoor space, and a panel 20 and a suction grille 21, which may be provided at a lower end of the cabinet 10 to form an exterior of a lower surface thereof, and exposed to a lower side of the ceiling when the indoor device 1 is installed.

The cabinet 10 may include an outer plate 11, which may form an exterior thereof, and an inner case 12, which may be provided inside of the outer plate 11. The outer plate 11 may be formed so that an exterior of the cabinet 10, a lower surface of which is open, is formed of a steel material having a plate shape. The outer plate 11 may be formed by coupling elements forming each of surfaces thereof, and may also be formed to be bent, and thus, to have at least one surface.

The inner case 12 may be formed at an inner side surface of the outer plate 11. The inner case 12 may be formed of an insulating material, such as expanded polystyrene (EPS), for example, and serve to insulate an inside of the cabinet 10 and prevent noise and vibration. The inner case 12 may be in close contact with the outer plate 11, and form an internal shape of the cabinet 10, and may be formed so that a surface thereof, which is in contact with the panel 20, is completely open.

A heat exchanger 30, which exchanges heat with suctioned air, a fan 40 which forcibly suctions in and discharges indoor air, an air guide 50 that guides the air suctioned in toward the fan 40, a drain pan assembly 60, which collects condensate generated from the heat exchanger 30, and a condensate pump 70, which discharges the collected condensate to an outside, may be provided inside of the cabinet 10. The panel 20 may be installed at a lower end of the cabinet 10, and may be formed in an approximately quadrangular shape when viewed from a bottom. The panel 20 may be formed to protrude further outward than the lower end of the cabinet 10, such that a perimeter thereof is in contact with a lower surface of the ceiling.

At least one panel outlet port 22, which serves as an exit of the air discharged through the cabinet 10, may be formed at the panel 20. The panel outlet port 22 may be formed at both side of the panel 20 which face each other, and may be formed at locations corresponding to outer ends of the cabinet 10. Each panel outlet port 22 may be formed to extend in a lengthwise direction of the panel 20, and may be opened and closed by a vane 23 installed or provided at the panel 20.

The suction grille 21 may be installed or provided at a center portion of the panel 20, and may form a portion of an exterior of a lower surface of the indoor device 1. The suction grille 21 may be located between one pair of panel outlet ports 22, and may be formed in a plate shape to shield an opening formed at the center portion of the panel 20.

The suction grille 21 may form a passage for the air which is introduced into the indoor device 1. That is, at least a portion of the suction grille 21 may be formed in a grille or grid shape so that the indoor air may be smoothly introduced.

Figure 3:
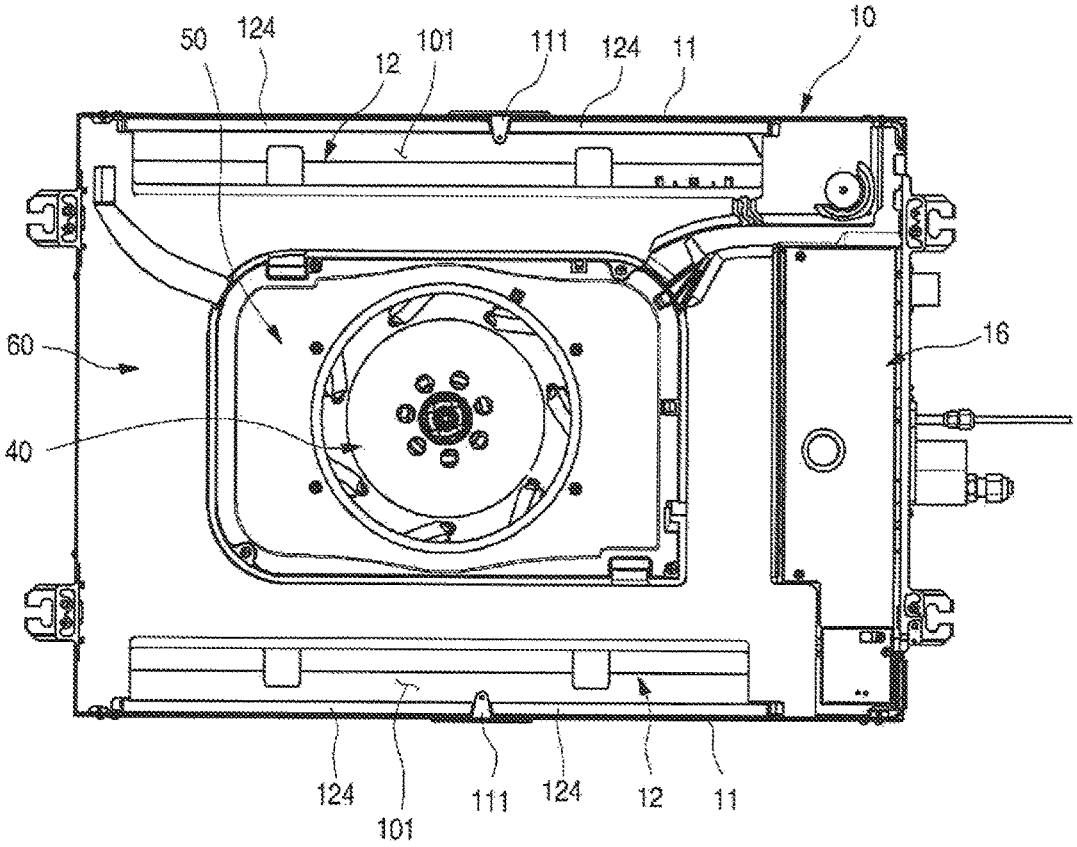
FIG. 3 is a plan view illustrating a state in which a drain pan assembly according to an embodiment is installed.

FIG. 3 is a plan view illustrating a state in which the drain pan assembly according to the embodiment is installed. As illustrated in the drawing, the fan 40 may be provided at an internal space of the inner case 12, and the heat exchanger 30 may be provided around the fan 40. The heat exchanger 30 may extend along an inner side surface of the inner case 12, and be spaced apart from a wall surface of the inner case 12 and the fan 40. Therefore, the air, which is suctioned in an axial direction of the fan 40, may be discharged while being rotated in a circumferential direction of the fan 40, and may exchange heat with a refrigerant while passing through the heat exchanger 30.

The drain pan assembly 60 may be provided at an open surface of the cabinet 10 to shield the open surface of the cabinet 10. The drain pan assembly 60 may be seated on an upper end of the inner case 12.

By installing the drain pan assembly 60, outlet ports 101 may be defined at both sides of the cabinet 10, respectively. The outlet ports 101 are passages through which the heat-exchanged air blown by the fan 40 may be discharged, and may be formed at positions corresponding to the panel outlet ports 22 to be in communication with each other, such that the heat-exchanged air may pass, in turn, through the outlet ports 101 and the panel outlet ports 22, and be discharged to the indoor space. That is, the outlet ports 101 may be formed by coupling the inner case 12 to the drain pan assembly 60, and thus, a portion of each of the outlet ports 101 may be formed by the inner case 12, and a remaining portion thereof may be formed by the drain pan assembly 60.

Hereinafter, structures of the inner case 12 and the drain pan assembly 60 will be described.

Figure 4:
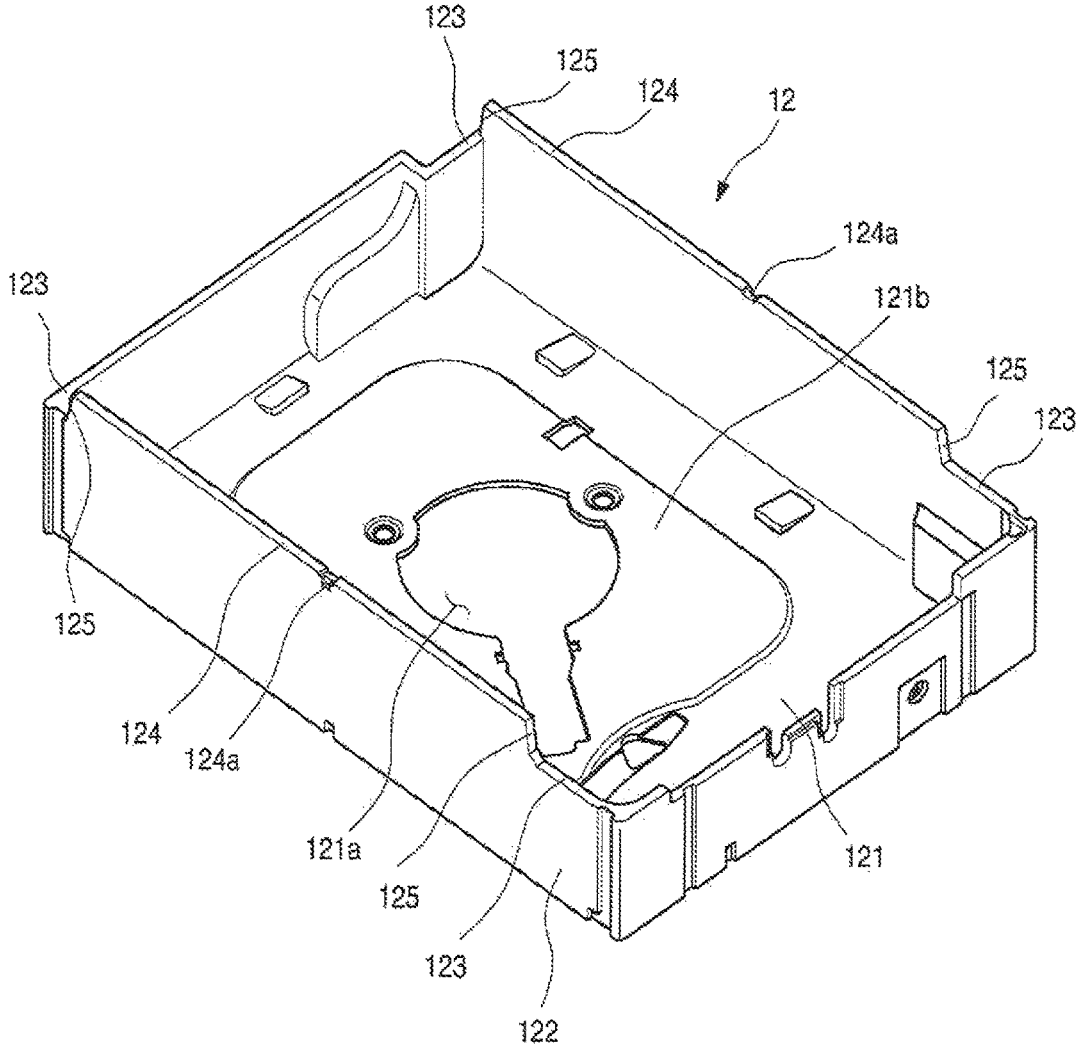
FIG. 4 is a perspective view of an inner case according to an embodiment.
Figure 5:
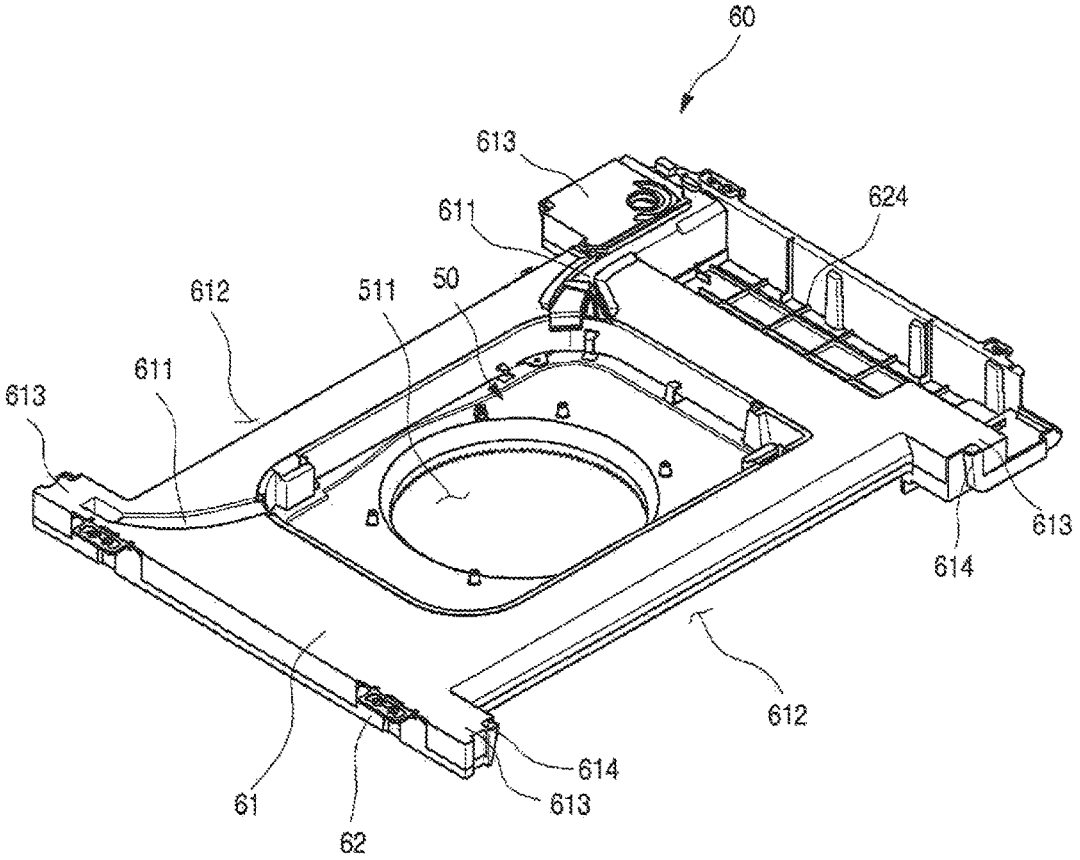
FIG. 5 is a perspective view of the drain pan assembly according to an embodiment.
Figure 6:
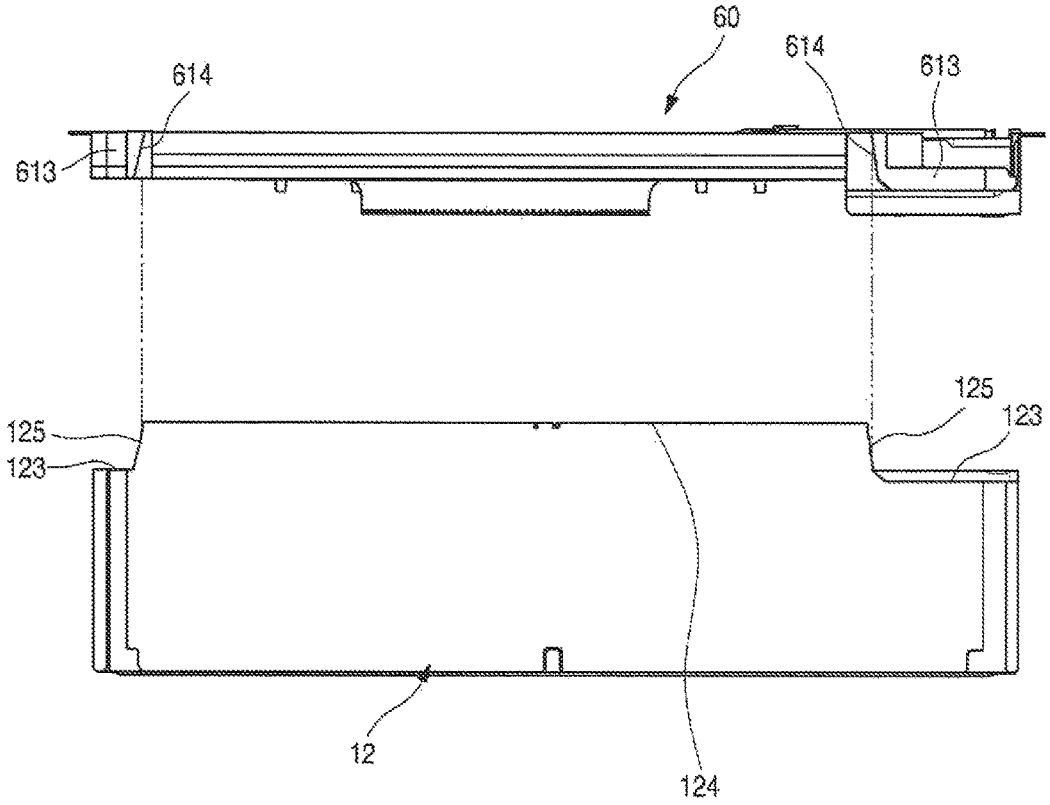
FIG. 6 is a side view illustrating a coupling structure between the inner case and the drain pan assembly according to an embodiment.

FIG. 4 is a perspective view of an inner case according to an embodiment. FIG. 5 is a perspective view of the drain pan assembly according to an embodiment. FIG. 6 is a side view illustrating a coupling structure between the inner case and the drain pan assembly according to an embodiment.

As illustrated in the drawings, the inner case 12 may be formed in a hexahedral shape, one surface of which may be open, and may be injection-molded as a single structure.

Alternatively, the inner case 12 may be formed by coupling elements forming a plurality of surfaces to each other. The inner case 12 may be formed to have at least two surfaces each having the outlet port 101.

The inner case 12 may include a bottom portion or bottom 121, which may form a lower surface of the inner case 12, and a perimeter portion or perimeter 122, which may extend along a perimeter of the bottom 121 to have a predetermined height. A case hole 121*a*, which enables the fan 40 to be fixed to a bottom surface of the outer plate 11, may be open at the bottom 121. An installation guide portion or guide 121*b*, which may be in contact with an inner side surface of the heat exchanger 30 and guide an installation location of the heat exchanger 30, may be formed to protrude.

In FIG. 4, the perimeter 122 of the inner case 12 is formed so that heights of first and second (front and rear) surfaces thereof are higher than heights of third and fourth (both side) surfaces. The first and second surfaces at the perimeter 122 having the higher heights may extend to an upper end of the cabinet 10.

A stepped portion or step 123 may be formed at both of side ends of the perimeter 122 of the inner case 12. The step 123 may serve to enable both sides of the drain pan assembly 60 to be seated thereon, and may be formed to be recessed downward. The step 123 may correspond to a seating portion or seat 613 of the drain pan assembly 60.

A height of the step 123 may be the same as a height of each of both of the side surfaces of the perimeter 122, and thus, an upper end of the step 123 may be formed to be continuously connected to both of the side surfaces of the perimeter 122. The seat 613 of the drain pan assembly 60 may be supported by upper ends of the both of the side surfaces of the perimeter 122.

The step 123 at one or a first side among the steps 123 at both sides may be formed to be wider than the step 123 at the other or a second side, and may provide a space in which a control box 16 that controls driving of the indoor device 1 may be provided. Also, there is a difference in a shape between the sides of the drain pan assembly 60 matched with the inner case 12 due to a difference in a width of the step 123. Therefore, the drain pan assembly 60 may be assembled with directionality, and thus, may be prevented from being erroneously assembled.

An extended portion or extension 124 may be formed to naturally protrude upward between the pair of steps 123. The extensions 124 may extend to an end of the outer plate 11, that is, the open end of the cabinet 10, and form one end of the outlet port 101.

An extended portion groove or extension groove 124*a* may be formed at an upper end of the extension 124, and a restriction piece or restrictor 111 that extends from the outer plate 11 may be bent and accommodated inside of the extension groove 124*a*, and thus, the inner case 12 may be installed and fixed inside of the outer plate 11.

A case inclined surface 125 may be formed at both ends of the extension 124. The case inclined surface 125 may be connected to the step 123 and be inclined outward from an upper side to a lower side. A line formed by the extension 124 and the step 123 may be in close contact with the seat 613 of the drain pan assembly 60.

The drain pan assembly 60 may include a body 61, a pan plate 62, which may form a surface directed toward an inside of the inner case 12, and the air guide 50, which may be installed at a center of the body 61. The body 61 may be formed of a same material as a material of the inner case 12, and may insulate the inside of the cabinet 10. The body 61 may form an entire shape of the drain pan assembly 60.

A plurality of wire guiding portions or guides 611, which may guide wires connected to the electronic components inside of the cabinet 10, such as the fan 40 and a temperature sensor (not shown), may be formed at an upper surface of the body 61 (in FIG. 5). The air guide 50 having an orifice hole 511 may be seated on the center of the body 61.

The pan plate 62 may be provided at a lower surface of the body 61. The pan plate 62 may accommodate a lower portion of the body 61, and form an entire lower surface of the drain pan plate 62. Although not illustrated, a space in which the condensate is collected may be formed at or in the pan plate 62, and the pan plate 62 may be formed to accommodate an end of the heat exchanger 30.

The pan plate 62 may be formed of a plastic material, and may have a structure in which the body 61 is fitted or bonded, and thus, coupled to the pan plate 62 after being molded. Also, the pan plate 62 may be formed by an insert injection molding when the body 61 is molded. If necessary, the pan plate 62 and the body 61 may be integrally formed of a same material.

A recessed portion or recess 612, which may be recessed inward, may be further formed at a portion of the drain pan assembly 60 corresponding to the extension 124. The recess 612 may have a shape which is recessed perpendicularly to an extending direction of the extension 124. The recess 612 may be defined by the seat 613, which may extend from both side ends of the drain pan assembly 60.

When the inner case 12 and the drain pan assembly 60 are coupled to each other, both ends of the extension 124 may be in contact with both sides of the recess 612, and thus, the outlet port 101 may be formed. That is, the outlet port 101 may be formed by shielding one open surface of the recess 612 by the extension 124.

More specifically, the seat 613 may be formed in a shape which is matched with the step 123. A pan inclined surface 614 having a slope corresponding to a slope of the case inclined surface 125 may be formed at a surface of the seat 613. Therefore, when the drain pan assembly 60 is installed, the seat 613 may be seated on the step 123, and the case inclined surface 125 and the pan inclined surface 614 may be matched or mated with each other. The case inclined surface 125 may be formed to be gradually directed outward toward a lower side thereof, to be naturally matched or mated when the drain pan assembly 60 is installed, and thus, to be airtight therebetween. A distance between the seats 613 may be formed to correspond to a transverse length of the extension 124, and both ends of the extension 124 may be in contact with both of the seats 613, respectively.

A box seating portion or seat 624, on which the control box 16 may be seated, may be formed at one side of the drain pan assembly 60. The box seat 624 may be recessed inward, and an open portion thereof may be shielded by the outer plate 11 when the drain pan assembly 60 is installed, and thus, a space in which the control box 16 may be accommodated may be formed.

Hereinafter, an assembling process of the indoor device having such a structure will be described.

Figure 7:
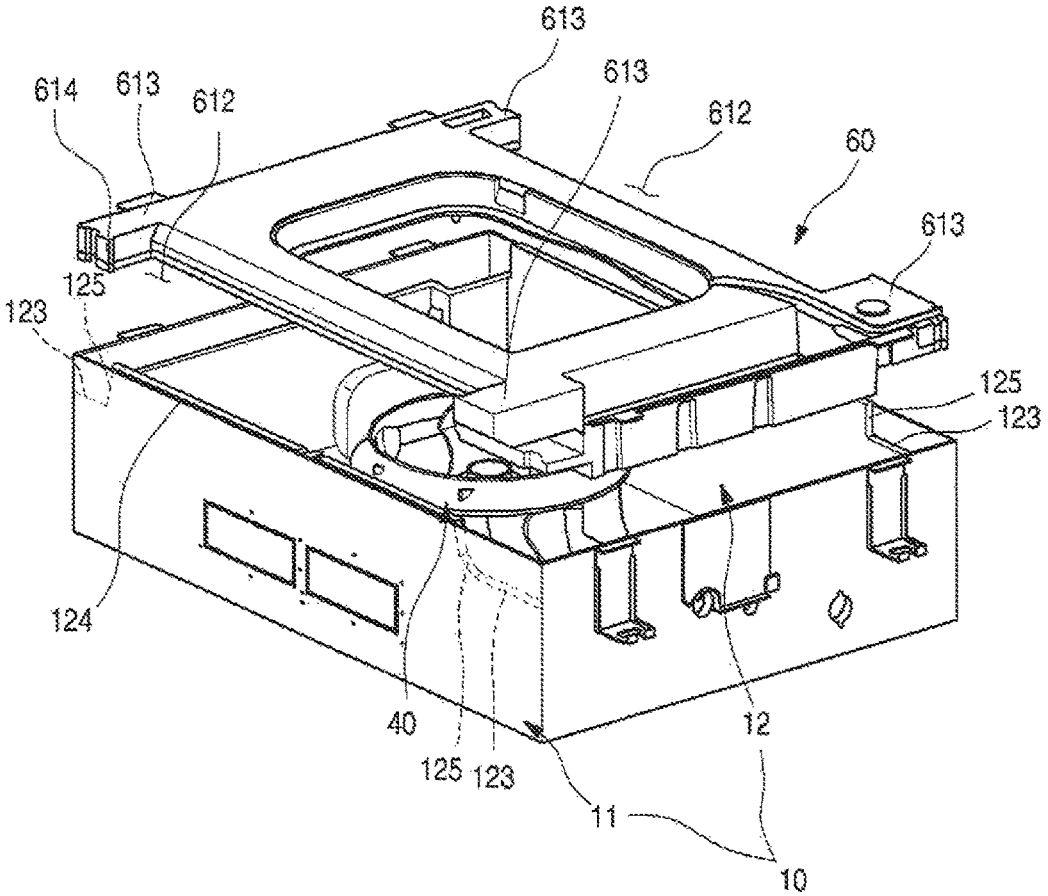
FIG. 7 is a perspective view illustrating a state in which the inner case and the drain pan assembly are separated from each other according to an embodiment.
Figure 8:
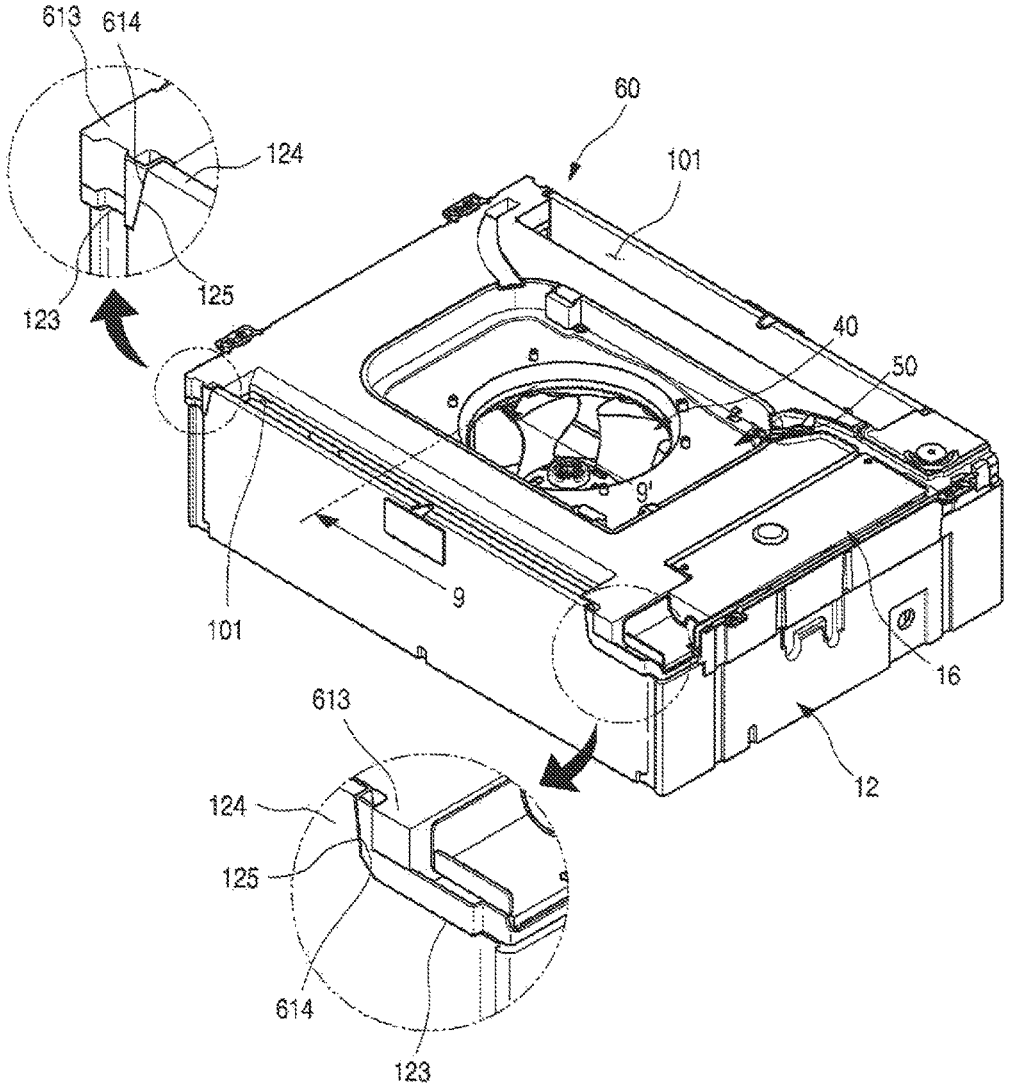
FIG. 8 is a perspective view illustrating a state in which the inner case and the drain pan assembly are coupled to each other according to an embodiment.

FIG. 7 is a perspective view illustrating a state in which the inner case and the drain pan assembly are separated from each other according to an embodiment. FIG. 8 is a perspective view illustrating a state in which the inner case and the drain pan assembly are coupled to each other according to an embodiment.

First, the inner case 12 may be installed inside of the outer plate 11 which may form the exterior of the indoor device 1, and then the fan 40, a fan motor, the heat exchanger 30, and the control box 16, for example, on may be installed inside of the inner case 12. In a state in which all of the elements inside of the cabinet 10 are arranged, the drain pan assembly 60 may be installed. The drain pan assembly 60 may be seated on the upper end of the inner case 12.

When the drain pan assembly 60 is seated, the seat 613 of the drain pan assembly 60 may be seated on the step 123 of the inner case 12. When the drain pan assembly 60 is seated on the upper end of the inner case 12, the pan inclined surface 614 and the case inclined surface 125 may be completely and airtightly in close contact with each other.

While the drain pan assembly 60 is installed, the upper end of the extension 124 may be located on a same plane as an upper surface of the drain pan assembly 60. When the inner case 12 and the drain pan assembly 60 are coupled, the outlet port 101 may be formed, and as the extension 124 extends to an upper end of the outer plate 11, a separate joining portion for sealing may not need to be formed at an inner area of the outlet port 101.

Hereinafter, an air flow in the indoor device according to an embodiment will be described.

Figure 9:
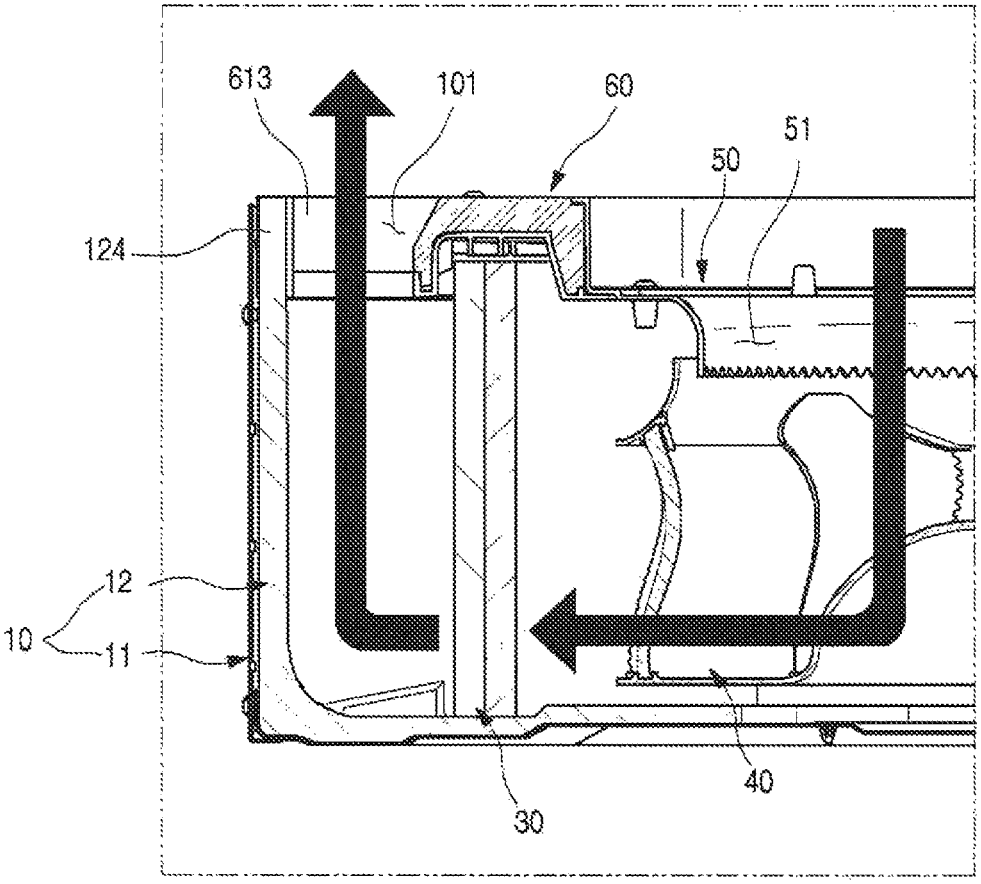
FIG. 9 is a view illustrating a state in which air is discharged from the indoor device according to an embodiment.

FIG. 9 is a view illustrating a state in which air is discharged from the indoor device according to an embodiment. As illustrated in the drawing, when an operation of the indoor device 1 starts, the fan 40 may be rotated by driving of the fan motor (not shown). The air in the indoor space may be suctioned toward a center side of the fan 40 through the suction grille 21 by rotation of the fan 40, and the suctioned air may be discharged while being rotated in a circumferential direction of the fan 40, exchange heat while passing through the heat exchanger 30, and then be discharged into the indoor space through the panel outlet port 22. The air discharged by the fan 40 may be discharged while being rotated, pass through the heat exchanger 30, and then flow toward the outlet port 101 along the wall surface of the inner case 12. As the separate joining portion is not formed in a discharging direction of the air from a lower end of the inner case 12 to an upper end thereof which guide the air flow, the discharged air may be smoothly guided along the perimeter 122 of the inner case 12 including the extension 124, and may be discharged to the indoor space through the panel outlet port 22.

Embodiments having the above-described configuration may have at least the following advantages.

First, the outlet port through which the heat-exchanged air is discharged may be formed by coupling the inner case and the drain pan assembly, and more particularly, an outer surface of the drain pan may have a shape which is recessed to form the outlet port. Therefore, a portion having a weak strength for forming the outlet port is removed, and thus, durability thereof may be enhanced.

Second, as an outer end of the outlet port is formed by the extension, and the extension extends to the open upper end of the cabinet, the joining portion is not formed on a route along which the discharged air flows, and thus, noise and vibration may be prevented when the air flows. Also, a sealing performance may be enhanced due to removal of the joining portion, and thus, insulation may be further enhanced.

Third, due to the structure in which the seat is matched with and seated on the step when the drain pan assembly is installed, and the structure in which the inclined surface is formed in an installing direction and matched or mated when the drain pan is installed, the drain pan assembly and the inner case may be easily coupled to each other, and may also be in close contact with each other.

Figure 10:
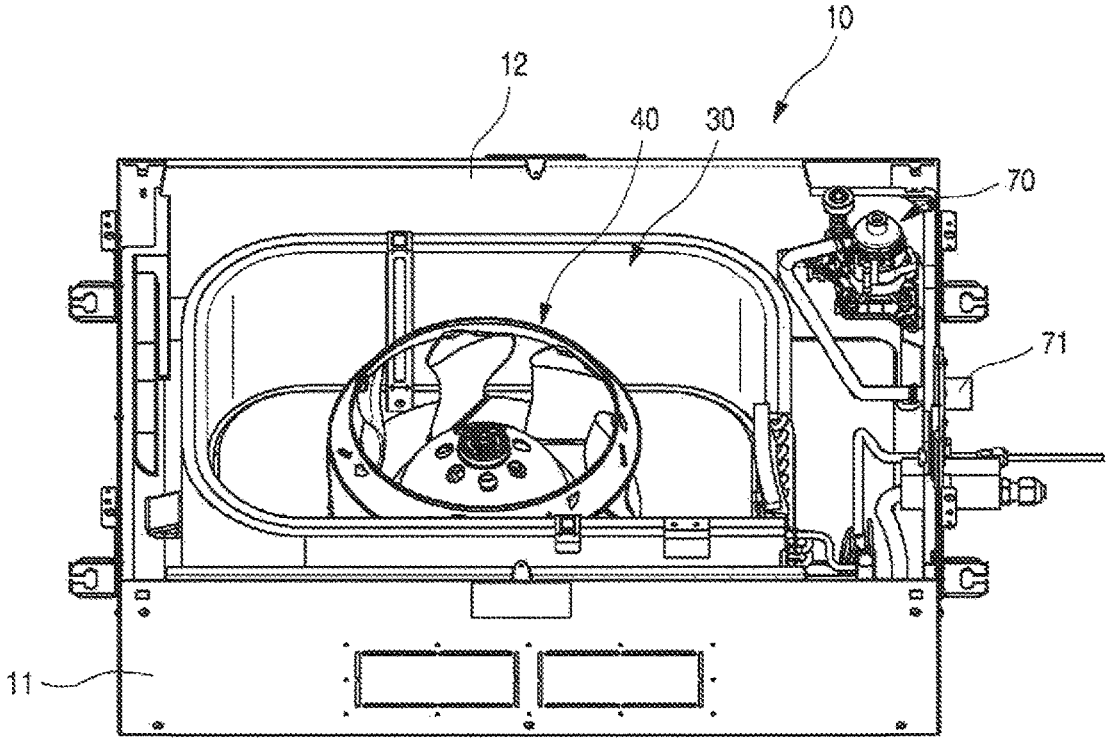
FIG. 10 is a perspective view illustrating an internal structure of a cabinet of the indoor device according to the embodiment.

FIG. 10 is a perspective view illustrating an internal structure of a cabinet of the indoor device according to the embodiment. As illustrated in the drawing, the fan 40 may be provided at an inner space of the inner case 12, and the heat exchanger 30 may be disposed or provided around the fan 40. The heat exchanger 30 may be disposed or provided along the inner side surface of the inner case 12, and spaced apart from the wall surface of the inner case 12 and the fan 40. Therefore, the air which is suctioned in the axial direction of the fan 40 may be discharged while being rotated in the circumferential direction of the fan 40, and may exchange heat with the refrigerant while passing through the heat exchanger 30.

The condensate pump 70 may be provided at one side end in the cabinet 10, and a condensate pipe 71 connected to the condensate pump 70 may pass through the cabinet 10, may extend to an outside, and thus, may discharge the condensate in the indoor device 1 to the outside. And although not illustrated, a control box (not shown) that controls electronic components inside of the indoor device 1, such as the fan 40, the condensate pump 70, various valves, and the temperature sensor, for example, may be further provided at the inner space of the cabinet 10 in which the condensate pump 70 is disposed or provided.

Figure 11:
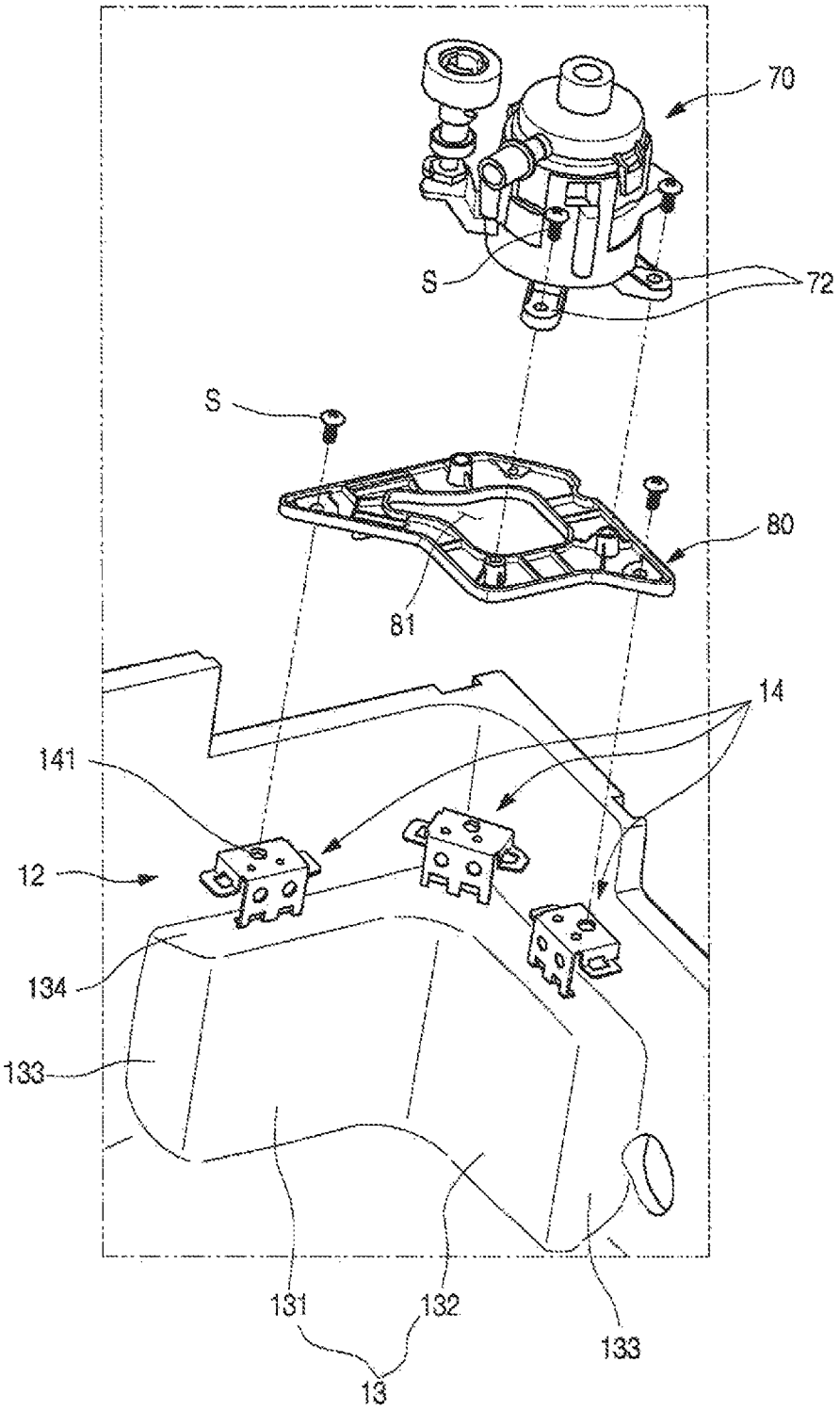
FIG. 11 is an exploded perspective view illustrating an installation structure of a condensate pump according to an embodiment.

FIG. 11 is an exploded perspective view illustrating an installation structure of a condensate pump according to an embodiment. As illustrated in the drawing, a mounting portion or mount 13, which may be formed to protrude inward, may be formed at a corner at which adjacent perimeter surfaces of the inner case 12 are in contact with each other. The mount 13 may be integrally formed with the inner case 12 when the inner case 12 is molded, and alternatively, may be separately formed, and then may be installed and fixed to an inner corner of the inner case 12.

More specifically, the mount 13 may be formed to protrude from the inner corner of the inner case 12, and to protrude along the side surfaces which are in contact with each other. A protruding thickness of the mount 13 may be formed smaller than a width of the condensate pump 70, and may be formed so that an outer surface of the condensate pump 70 protrudes toward a center of the cabinet 10 further than an outer surface of the mounting portion 13.

That is, the mount 13 may include a first side surface 131, which protrudes along a first side surface of the inner case 12, and a second side surface 132, which protrudes along a second side surface thereof, which is in contact with the first surface and forms a corner together with the first side surface 131, and the corner, which is recessed inward, may be formed at an area at which the first side surface 131 and the second side surface 132 are in contact with each other.

The mount 13 may protrude to the inside of the cabinet 10, and a protruding side end 133 thereof may enable the air flowing along the side surface of the inner case 12 to naturally flow along the mount 13. The mount 13 may extend vertically to a predetermined height, such that the condensate pump 70 seated on an upper side of the mount 13 may easily collect the condensate collected in the drain pan assembly 60.

The height of the mount 13 may be formed lower than a height of the side surface of the inner case 12. Thus, the mount 13 may have an upper surface 134 which is stepped from the inner side surface of the inner case 12.

A mounting bracket 14 may be installed at the upper surface 134 of the mount 13. The mounting bracket 14 may be disposed or provided at the upper surface 134 of the mount 13, and may be disposed or provided at a location corresponding to a fastening location of a supporter 80, which will be described hereinbelow.

The mounting bracket 14 may be formed, for example, by bending a plate-shaped steel material, or may be formed of a plastic material having a high strength. Therefore, the mounting bracket 14 may reinforce an installation location of the condensate pump 70, and a fastening hole 141, through which a screw S may be fastened, may be provided at the mount 13. The mounting bracket 14 may be fitted to the mount 13, which may be formed of a relatively soft material, and may be formed by insert injection molding when the mount 13 is molded.

The supporter 80 may be seated on the upper surface 134 of the mount 13. The supporter 80, to which the condensate pump 70 may be fixed and supported, may provide a surface which enables the condensate pump 70 to be stably fixed to the mount 13.

The supporter 80 may be formed to have at least a size capable of accommodating a lower surface of the condensate pump 70 to be in contact with a pump fixing portion 72 that protrudes from a lower surface of the condensate pump 70 and to support the condensate pump 70. An opening 81 that enables the air flow and service of or to the condensate pump 70 may be formed at a center of the supporter 80.

Figure 12:
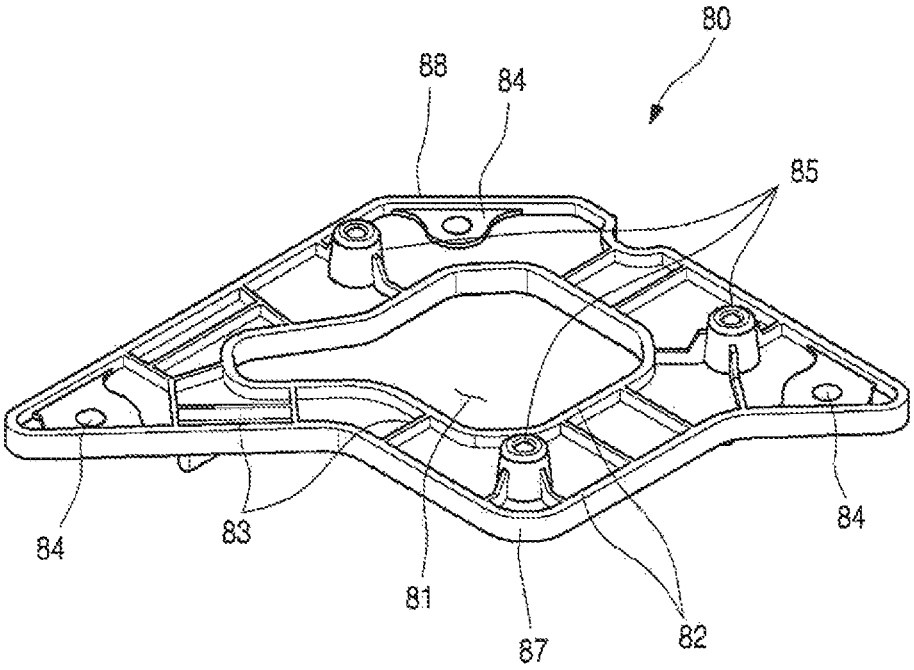
FIG. 12 is a perspective view illustrating a supporter when viewed from a top according to an embodiment.
Figure 13:
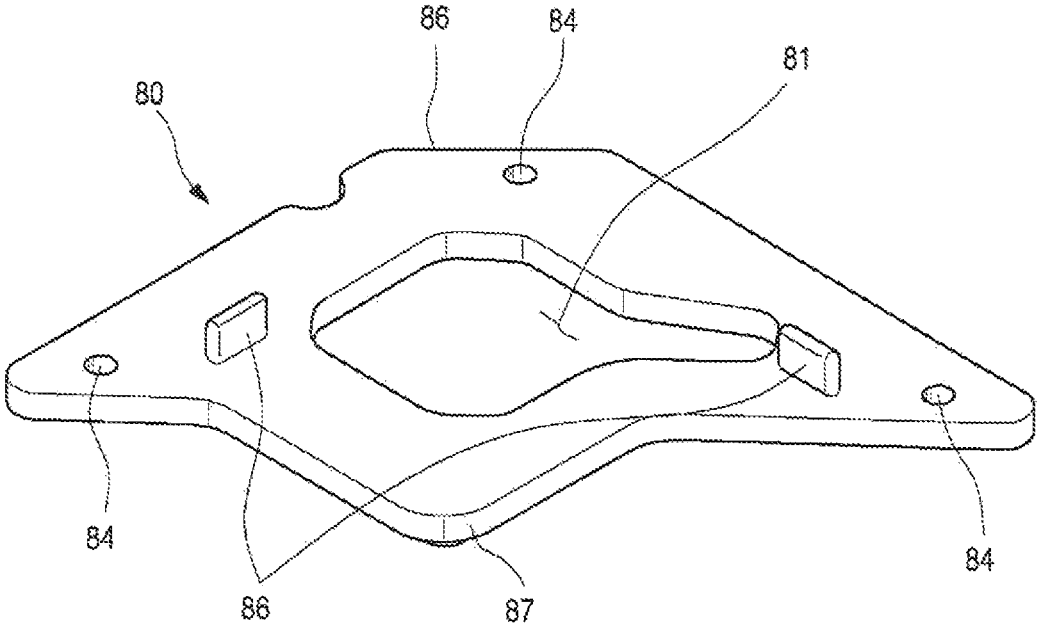
FIG. 13 is a perspective view illustrating the supporter when viewed from a bottom according to an embodiment.

FIG. 12 is a perspective view illustrating a supporter when viewed from a top according to an embodiment. FIG. 13 is a perspective view illustrating the supporter when viewed from a bottom according to an embodiment.

The supporter 80 will be further described with reference to the drawings. The supporter 80 may be formed in a plate shape, and may be formed to cross the upper surface 134 of the mount 13 and to connect the first side surface 131 with the second side surface 132.

A flange 82 may extend upward from inner and outer perimeters of the supporter 80, and a plurality of reinforcing ribs 83 that connects inner and outer flanges 82 with each other may be provided. Thus, a stably supported state of the condensate pump 70 may be maintained. One or more screw hole 84, in which screw S fastened to the mounting bracket 14 may be installed, may be formed on the supporter 80. By fastening the screw S, the supporter 80 may be coupled to the mounting bracket 14, and may be stably fixed to the mount 13.

At least one seating portion or seat 85, on which the pump fixing portion 72 of the condensate pump 70 may be seated, may be formed at an upper surface of the supporter 80. Each seat 85 may protrude to a predetermined height so that the lower surface of the condensate pump 70 may be spaced apart from a lower surface of the supporter 80, and air passing through the opening 81 of the supporter 80 may flow without interference with the lower surface of the condensate pump 70. By the coupling of the screw S passing through the pump fixing portion 72 and fastened to the seat 85, the condensate pump 70 may be installed and fixed to the supporter 80.

One or more guide portion or guide 86 may be formed at the lower surface of the supporter 80. Each guide 86 may serve to enable the supporter 80 to be seated at an exact location when the supporter 80 is installed at the upper surface 134 of the mount 13, and a plurality of guides 86 may be formed to protrude downward. A distance from one end of the supporter 80 to each of the guides 86 may be the same as a width of the upper surface 134 of the mount 13, such that the plurality of guides 86 may be in close contact with an outer surface of the mount 13, and thus, an installation location of the supporter 80 may be accurately guided.

A portion 88 of a perimeter of the supporter 80 may have a shape corresponding to a corner of the inner case 12, and thus, enable the portion 88 of the perimeter of the supporter 80 to be in close contact with the corner of the inner case 12 when the supporter 80 is installed. Another portion 87 of the supporter 80 opposed to the portion thereof which is in close contact with the inner case 12 may protrude in a direction opposite to the corner of the inner case 12, and provide a surface to which a portion of the pump fixing portion 72 may be fixed.

Hereinafter, an operation of the indoor device 1 of the air conditioner according to an embodiment having the above-described structure will be described.

Figure 14:
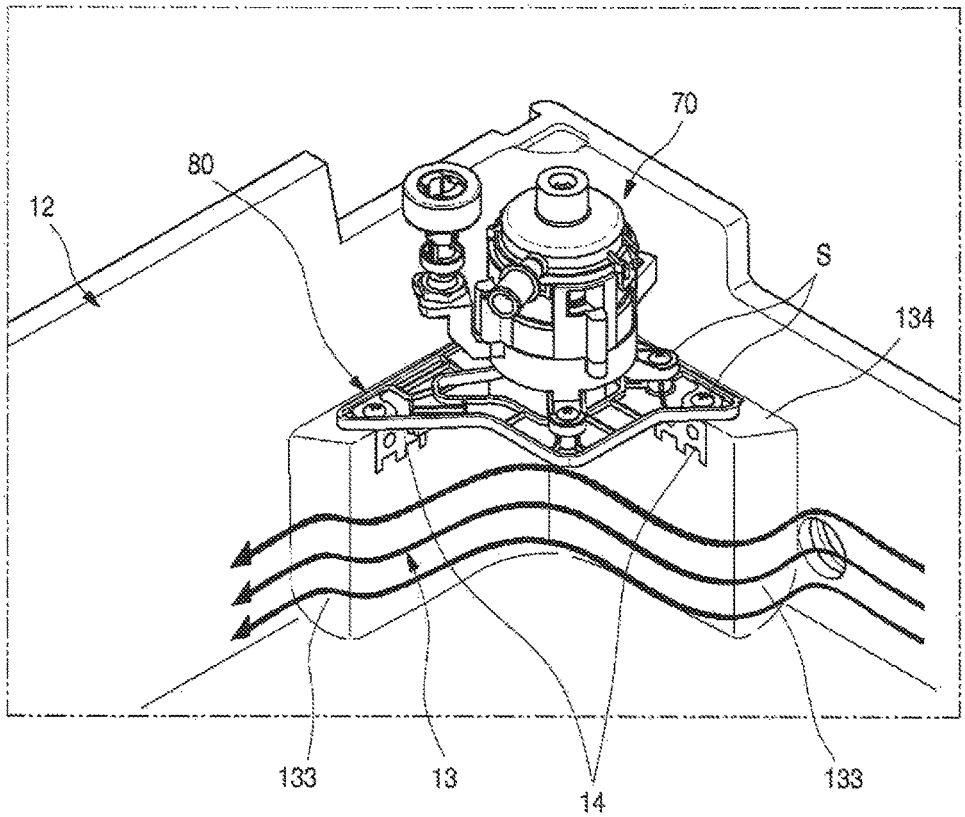
FIG. 14 is a view illustrating a flow of the air in the cabinet according to an embodiment.

FIG. 14 is a view illustrating a flow of the air in the cabinet according to an embodiment. As illustrated in the drawing, when operation of the indoor device 1 starts, the fan 40 may be rotated by the driving of the fan motor (not shown). The air in the indoor space may be suctioned toward the center of the fan 40 through the suction grille 21 by the rotation of the fan 40, and the suctioned air may be discharged while being rotated in the circumferential direction of the fan 40, exchange heat while passing through the heat exchanger 30, and then be discharged into the indoor space through the panel outlet port 22.

The air discharged by the fan 40 may be discharged while being rotated, pass through the heat exchanger 30, and then flow along the wall surface of the inner case 12. Some of the flowing air may be in contact with a protrusion of the mount 13, flow along a protrusion round of the mount 13, and thus, may smoothly flow along the mount 13 and the wall surface of the inner case 12 without colliding with the mount 13 or being delayed. The air flowing toward the supporter 80 may flow through the opening 81 of the supporter 80 without being delayed, and thus, noise and vibration due to turbulence may not be generated.

Figure 15:
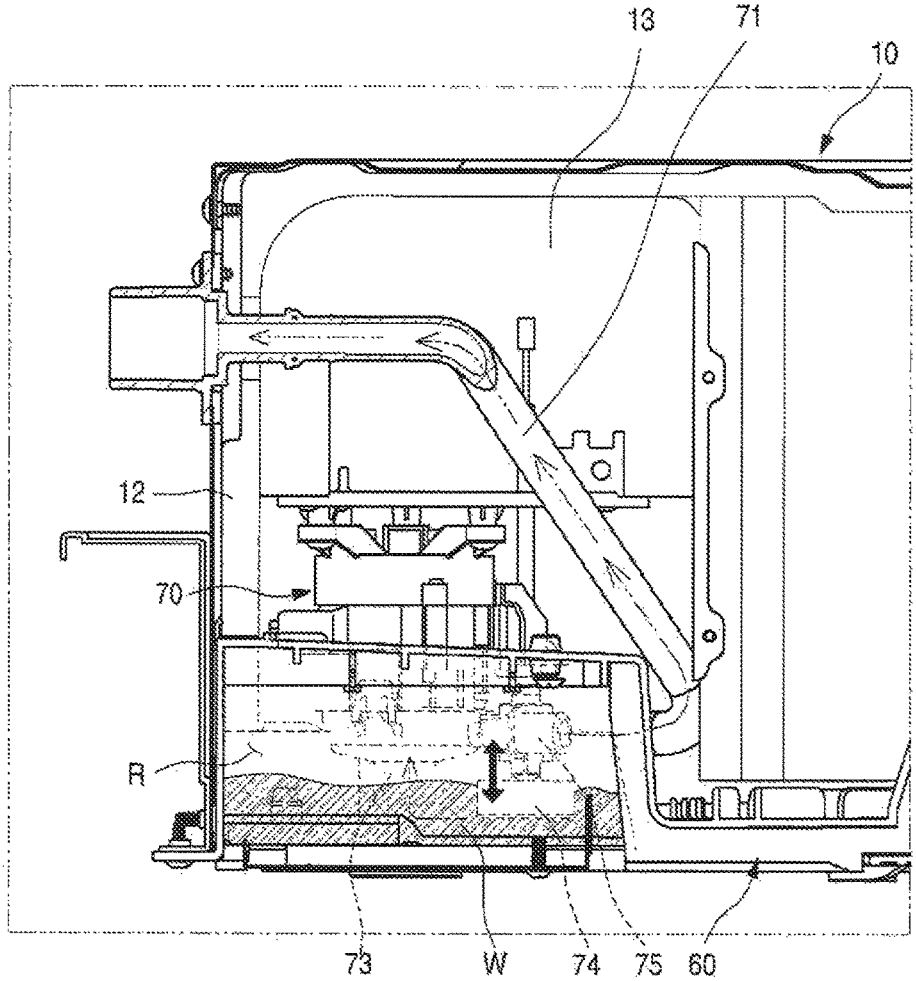
FIG. 15 is a view illustrating a driving state of the condensate pump according to an embodiment.

FIG. 15 is a view illustrating a driving state of the condensate pump according to an embodiment. As illustrated in the drawing, the condensate pump 70 may be maintained in a fixed state to the upper surface 134 of the mount 13 by the supporter 80. The condensate generated during operation of the indoor device 1 may be collected in the drain pan assembly 60, and more particularly, may be collected in a water collecting space at or in which the condensate pump 70 is located.

While the condensate pump 70 is installed at or on the mount 13, a suction portion or inlet 73 may be located inside of the water collecting space R, and the condensate pump 70 may be driven by a floater 74 of the condensate pump 70. Condensate W may be suctioned into the suction inlet 73 by driving of the condensate pump 70, and the suctioned condensate W may be discharged to the outside of the indoor device 1 through the condensate pipe 71 connected to a discharging portion or outlet 75.

Embodiments disclosed herein having the above-described configuration may have at least the following advantages.

First, the protruding of the mount to support the condensate pump may be minimized, and thus, passage resistance may be reduced, a flow rate increased, and noise reduced. Second, as the supporter, which crosses the mount may be installed at the upper surface of the mount, the protrusion of the mount may be narrow, and also, the condensate pump may be stably supported. Third, by adding the mounting bracket to the mount, which is formed of the insulating material and thus has a low strength, it is possible to provide a stable installation structure while reducing the pump fixing portion to the condensate pump.

Figure 16:
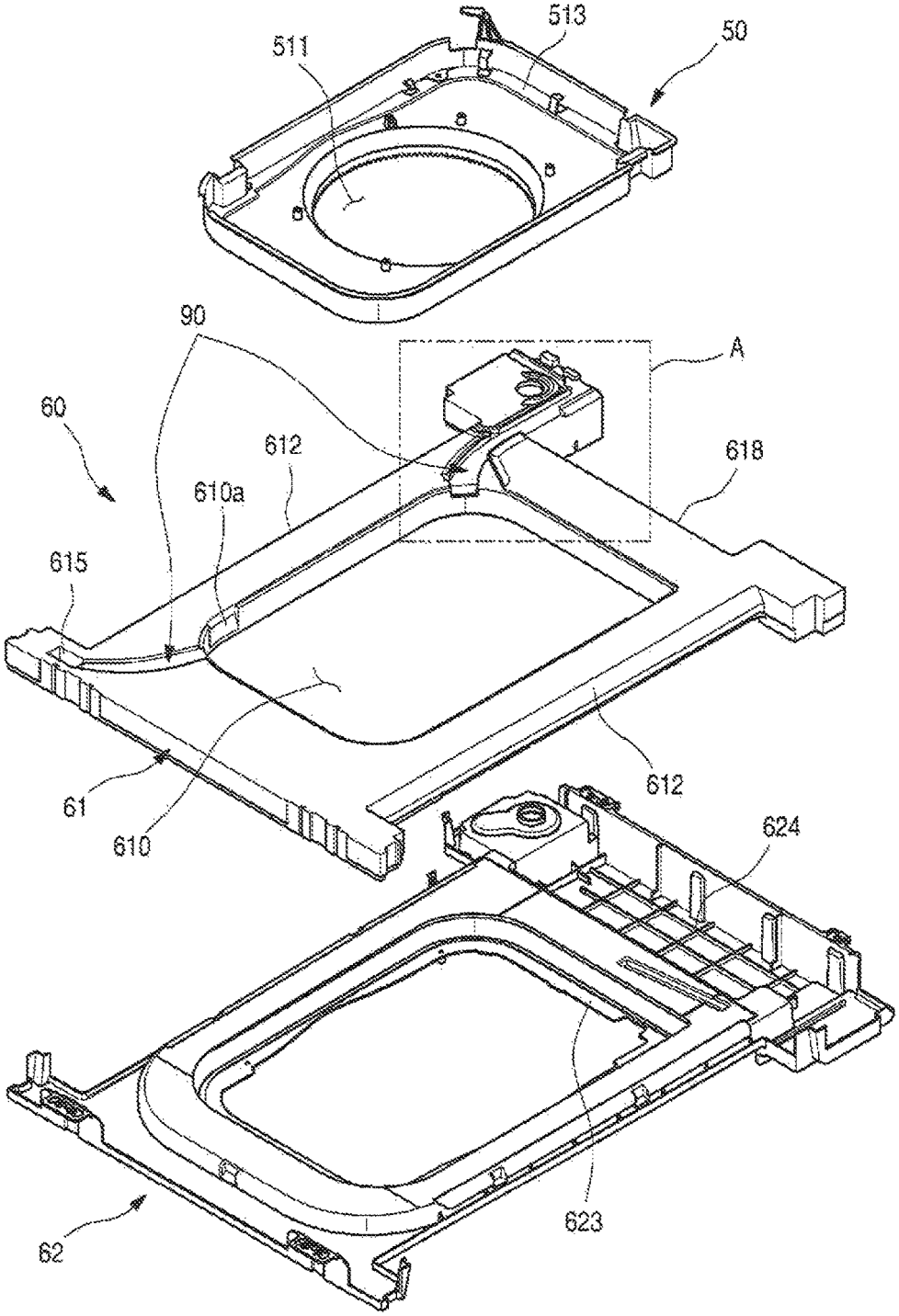
FIG. 16 is an exploded perspective view of the drain pan assembly according to the embodiment when viewed from a top.
Figure 17:
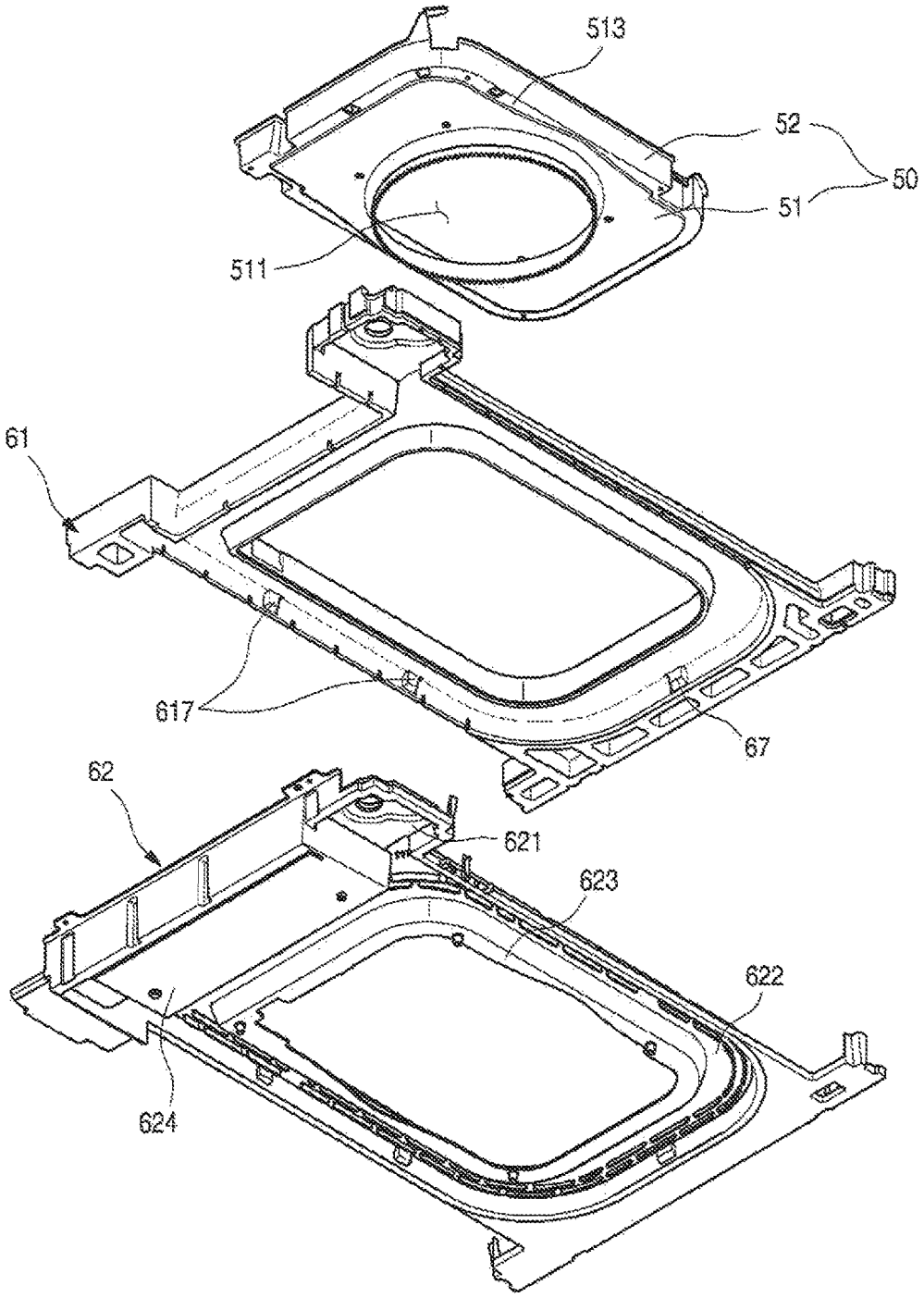
FIG. 17 is an exploded perspective view of the drain pan assembly when viewed from a bottom according to an embodiment.
Figure 18:
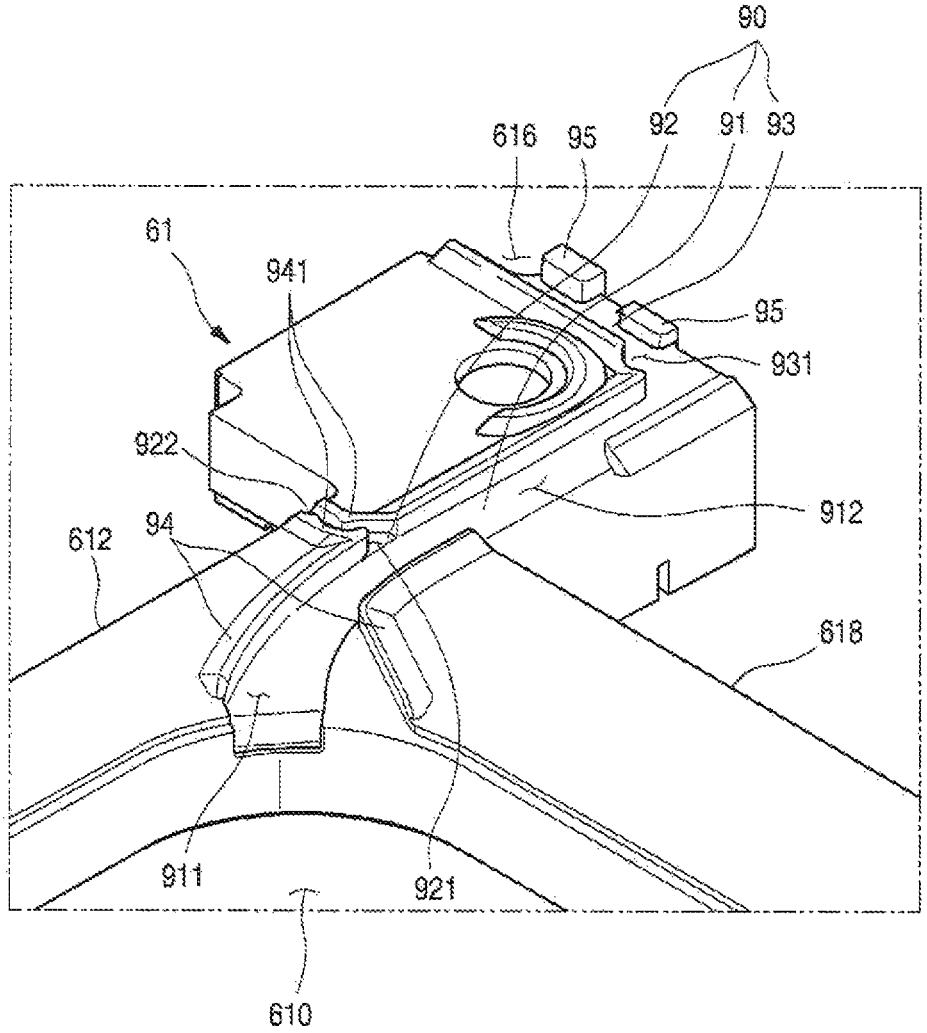
FIG. 18 is a partial perspective view illustrating a detailed structure of a portion A of FIG. 16.

FIG. 16 is an exploded perspective view of the drain pan assembly according to the embodiment when viewed from a top. FIG. 17 is an exploded perspective view of the drain pan assembly according to an embodiment when viewed from a bottom. FIG. 18 is a partial perspective view illustrating a detailed structure of a portion A of FIG. 16.

As illustrated in the drawings, the drain pan assembly 60 may include the body 61, the pan plate 62, which forms a surface facing the inside of the inner case 12, and the air guide 50, which may be installed at the center of the body 61. The body 61 may be formed of the same material as the material of the inner case 12, and may insulate the inside of the cabinet 10. The body 61 may form the entire shape of the drain pan assembly 60.

A body opening 610, in which the air guide 50 may be installed, may be formed at the center of the body 61. A panel inserting portion 610*a* may be formed at locations of an inner side surface of the body opening 610 which face each other. The panel inserting portion 610*a* may be formed at a location corresponding to a panel fixing portion 523 formed at the air guide 50, and provide a space in which a panel hook (not shown) of the panel 20 may be inserted when the air guide 50, which will be described hereinbelow is installed.

The recess 612, which is recessed inward, may be formed at both side surfaces of the body 61. The recess 612 may form the outlet port 101 when the drain pan assembly 60 is installed. A box accommodating portion 618, which may provide a space in which the control box 16 may be provided, may be further formed at another side surface of the body 61.

One or more wire guide portion or guide 90, which may extend from the body opening 610 to another side may be formed at the upper surface of the body 61. The wire guide 90 may be recessed downward, and a plurality of wire guides 90 may be formed at the upper surface of the body 61.

That is, as illustrated in FIG. 16, two wire guides 90 that extend from both sides in directions opposite to each other may be provided. One of the pair of wire guides 90 may extend to a wire hole 615 that passes through one side of the body 61 to be opened, and the other one may be formed to extend to the box accommodating portion 618.

Regardless of a model of the indoor device 1, all of wires L may be guided to the control box 16, and thus, the wires L may be provided along the wire guides 90 connected to at least the box accommodating portion 618. When an optional element is added to the indoor device 1, the wire L may be further provided along the wire guide 90 connected to the wire hole 615.

The wire guide 90 may be formed so that the open side thereof is wide, and may be formed to become narrower. Therefore, the wires which are introduced toward the wire guide 90 through the air guide 50 may be easily introduced into the wire guide 90 in various directions.

A guide portion or guide 94 that protrudes to a predetermined height may be further formed at a perimeter of the wire guide 90. The guide 94 may be integrally formed to protrude upward when the body 61 is molded, and form a space in which the wires L may be accommodated. That is, when the wire guide 90 is not recessed, the wire guide 90 may be defined by the guide 94. When the wire guide 90 is recessed, the space in which the wires L are accommodated may be further ensured.

The wire guide 90 may extend toward the box accommodating portion 618, may be branched into at least one or more portions, and thus, may enable electronic components at various locations to be guided and connected to the control box 16 by the wires L. That is, the wire guide 90 may include a main guide 91 that extends from a corner portion or corner of the body opening 610 to the box accommodating portion 618, a first branch portion or branch 92 connected from the main guide 91 to the recess 612, and a second branch portion or branch 93 connected from an end of the main guide 91 to a pump hole 616. More specifically, the main guide 91 may extend from the corner of the body opening 610 to one end of the body 61, and be in communication with the box accommodating portion 618. Therefore, the wire L, which is directed from the body opening 610 side toward the control box 16, may be guided to the control box 16. The main guide 91 may be formed to be wider than the first branch 92 and the second branch 93, and thus, to guide a relatively larger number of wires L.

The first branch 92 may be formed at one side of the main guide 91 to connect the recess 612, and also formed to guide the wires L connected to the electronic components provided at the recess 612 side toward the control box 16. The second branch 93 may be located at an extended end of the main guide 91, and formed to be connected to the pump hole 616 formed between the outer plate 11 and the drain pan assembly 60 when the drain pan assembly 60 is installed. Therefore, the wire L connected to the condensate pump 70 may be guided to the control box 16 via the pump hole 616 and the second branch 93.

One or more guide protrusion 95, which may prevent the wire L moving along the second branch 93 from being caught between the outer plate 11 and the drain pan assembly 60 or being shaken, may be further formed at the second branch 93. Each guide protrusion 95 may be provided along the second branch 93, and may be formed at an end of the body 61 which is in contact with the outer plate 11.

The guide 94 may be formed to extend along outer sides of the main guide 91, the first branch 92, and the second branch 93, such that each of the branches and connecting portions may be cut away to allow an access to the wires L. That is, a cut-away portion or cut-away formed at the guide 94 may be formed at an entrance 911 of the main guide 91 connected to the body opening 610, an entrance 921 of the first branch 92, an exit 922 of the first branch 92, which may be in contact with the recess 612, an exit 912 of the main guide 91 connected to the box accommodating portion 618, and an entrance 931 of the second branch 93.

A plurality of protrusions 941 that protrudes inward to fix the wires L moving between the guides 94, that is, along the wire guide 90 may be formed at the guide 94. The protrusions 941 may protrude in directions facing each other, and may be provided to cross each other, such that the wires L are fixed while being bent along the protrusions 941.

Although not illustrated in detail, elements defined as electronic components may include the fan motor 41 that rotates the fan 40, a vane motor that drives the vane 23, one or more temperature sensors, a plasma ionizer, the condensate pump 70, and various valves on a refrigeration cycle, for example. Of course, other elements which are not described may also be added, as long as the elements are provided at the indoor device 1, and required to be connected with the control box 16.

The lower surface of the body 61 may be formed in a shape corresponding to the pan plate 62 coupled from a lower side of the body 61. One or more plate fixing portion 617 that fixes the pan plate 62 may be formed at the lower surface of the body 61, and thus, a coupling force to the pan plate 62 may be enhanced.

The pan plate 62 may be provided at the lower side of the body 61. The pan plate 62 may accommodate a lower portion of the body 61, and form an entire lower surface of the drain pan assembly 60. The pan plate 62 may be formed of a different plastic material from the material of the body 61, may form an exterior of the lower surface of the drain pan assembly 60, and may protect the body 61.

A water collecting portion or collector 621, in which the condensate may be collected, may be formed at the pan plate 62, and a suction side of the condensate pump 70 may be located at or in the water collector 621 to discharge the collected condensate.

A heat exchanger accommodating portion 622, in which an end of the heat exchanger 30 may be accommodated, may be formed at the pan plate 62, and an orifice seating portion or seat, 623, which may protrude inside of the body opening 610, may be formed at a center of the pan plate 62. The orifice seat 623 may be formed in a shape corresponding to an orifice matching portion 513 formed at a bottom surface 51 of the air guide 50, and formed to support the air guide 50 while the air guide 50 is seated thereon.

A control box seating portion or seat 624, which may be disposed or provided at a side of the box accommodating portion 618 when being coupled to the body 61, and thus, enable the control box 16 to be seated thereon, may be further formed at one side of the pan plate 62.

The pan plate 62 may have a structure in which the body 61 may be fitted or bonded to the pan plate 62 after being injection-molded with a plastic material. Also, the pan plate 62 may be formed by insert injection molding when the body 61 is molded. Further, the pan plate 62 and the body 61 may be integrally formed of the same material.

The air guide 50 may be provided inside of the body opening 610 to shield the body opening 610, and form a passage through which external air may be suctioned in through the orifice hole 511 and flow toward the fan 40.

Figure 19:
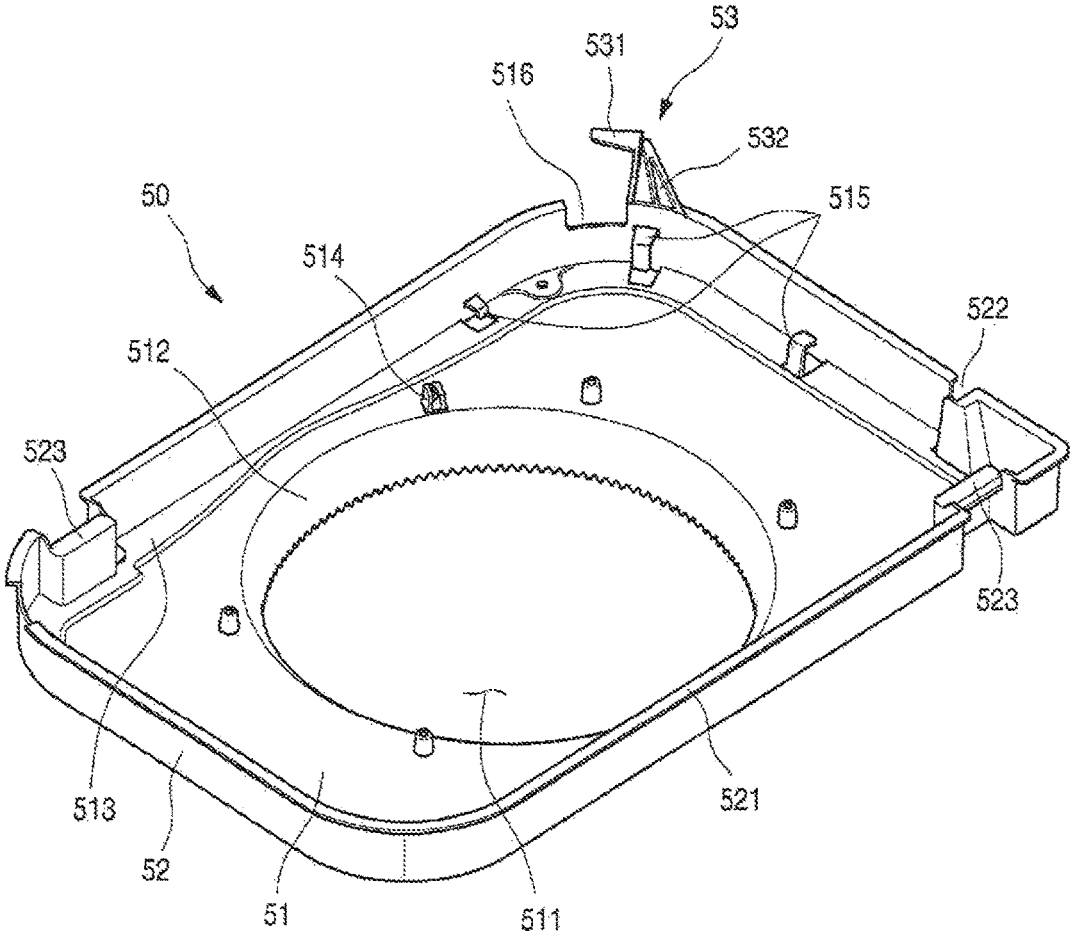
FIG. 19 is a perspective view of an air guide according to an embodiment.

FIG. 19 is a perspective view of an air guide according to an embodiment. As illustrated in the drawing, the air guide 50 may include the bottom surface 51 and a perimeter surface 52. The bottom surface 51 may be formed to shield the body opening 610, and the perimeter surface 52 may be formed to extend upward along a perimeter of the bottom surface 51 and to be in contact with an inner side surface of the body opening 610. A flange portion or flange 521, which may be bent outward, may be formed at an upper end of the perimeter surface 52, and the flange 521 may have a structure configured be seated on a perimeter of the body opening 610 of the upper surface of the body 61.

The panel fixing portion 523 may be recessed at a location of the perimeter surface 52 of the air guide 50 corresponding to the panel inserting portion 610*a*. The panel fixing portion 523 may be recessed so that a hook of the panel 20 may be inserted therein, and also formed so that an end of the hook may be hooked and restricted.

A wire exit 522 may be formed at one side of the perimeter surface 52 of the air guide 50. The wire exit 522 may be formed so that a portion of the perimeter surface 52 and the bottom surface 51 of the air guide 50 is open, and thus, the wire L under the drain pan assembly 60 may be guided to an outside of the air guide 50 through the wire exit 522. A location of the wire exit 522 may be formed at one side surface of the air guide 50 which corresponds to a location at which both ends of the heat exchanger 30 and a plurality of valves may be located, and which may be close to the control box 16.

The orifice hole 511 may be open at the bottom surface 51 of the air guide 50. A circumference of the orifice hole 511 may extend toward the fan 40, and form an extending portion or extension 512. An end of the extension 512 may be formed in a saw-tooth shape, and reduce noise generated when the air flows.

The orifice matching portion 513 may be formed at the bottom surface 51 of the air guide 50. The orifice matching portion 513 may be formed along a perimeter of the bottom surface 51 of the air guide 50, and formed to be stepped and to be matched or mated with the orifice seat 623 formed at the pan plate 62. Therefore, the air guide 50 may be maintained in a seated state on the pan plate 62. The air guide 50 may be installed and fixed by a fastening member, such as a screw, which may pass through the orifice matching portion 513 and the orifice seat 623 and be fastened thereto.

A wire fixing portion 514 may protrude from an upper surface of the bottom surface 51 of the air guide 50. The wire fixing portion 514 may be formed at a location close to the orifice hole 511, and formed to fix the wire L guided inside of the orifice hole 511. More specifically, the wire fixing portion 514 may include a pair of ribs or protrusions so that the wire L may be accommodated therebetween, may be formed to have elasticity, and may also be formed to be open upward, such that the wire L may be fitted and fixed therein.

A plurality of wire holders 515 may be provided at the bottom surface 51 and the perimeter surface 52 of the air guide 50. The wire holders 515 may be formed at the perimeter surface 52 of the air guide 50 or the bottom surface 51 close to the perimeter surface 52, and fix the wire L so that the wire L is directed toward the wire guide 90.

The plurality of wire holders 515 may protrude from the bottom surface 51 or the perimeter surface 52 of the air guide 50, and ends thereof may be bent toward the bottom surface 51 or the perimeter surface 52 of the air guide 50. Therefore, the wire L may be fixed while being in close contact with the bottom surface 51 or the perimeter surface 52 of the air guide 50, and may be maintained in a fixed state without being shaken.

The plurality of wire holders 515 may be provided from the wire exit 522 to the wire guide 90, and may also be formed so that extending directions of the wire holders 515 cross each other, and thus, fixing of the wires L through the wire holders 515 may be effectively performed. The wire holder 515 may also be formed between the wire fixing portion 514 and the wire guide 90.

A wire restricting member or restrictor 53 may be provided at one side of a corner of the perimeter surface 52 of the air guide 50. The wire restrictor 53 may serve to press and fix the wire L disposed or provided at the wire guide 90, and may be formed to extend from the perimeter surface 52 of the air guide 50 to the outside.

A portion of the perimeter surface 52 of the air guide 50 corresponding to the wire guide 90 may be cut away so that the wire L may be easily introduced. The wire restrictor 53 may be formed at a side end of a cut-away portion or cut-away 516.

Figure 20:
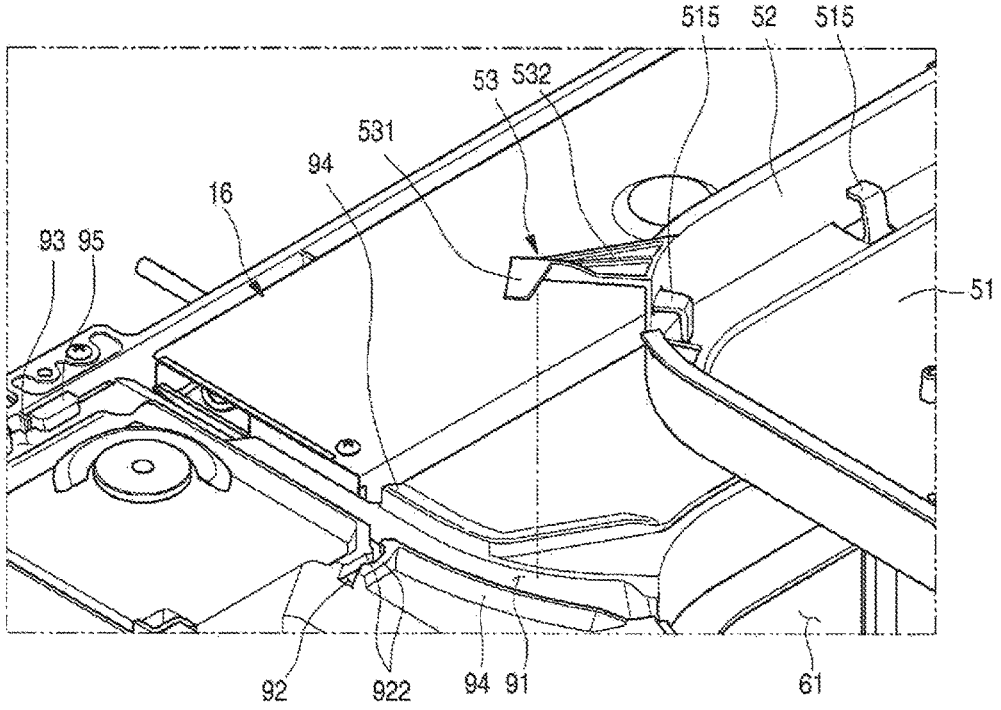
FIG. 20 is a partial perspective view illustrating a coupling structure of a wire restricting member or restrictor according to an embodiment.

FIG. 20 is a partial perspective view illustrating a coupling structure of a wire restricting member or restrictor according to an embodiment. A structure of the wire restrictor 53 will be described hereinafter with reference to the drawing.

The wire restrictor 53 may extend from an upper end of the perimeter surface 52 of the air guide 50, and extend to be in contact with the upper surface of the body 61. The wire restrictor 53 may extend along an outer side of the wire guide 90.

The wire restrictor 53 may be formed so that a width of a portion thereof which is in contact with the perimeter surface 52 of the air guide 50 is the widest, and then becomes narrower in an extending direction. A restrictor 531, which crosses the wire guide 90 at an upper side thereof, may be further formed at an end of the wire restrictor 53, which extends a predetermined length. The restrictor 531 may serve to press and fix the wires provided along an inside of the wire guide 90, and be formed in a shape that extends upward from an end of the wire restrictor 53 and then is bent laterally. The restrictor 531 may be formed at the end of the wire restrictor 53, which extends along the wire guide 90, and thus, may press and fix the wire L, which may be provided on the wire guide 90, at a location which is distant from an entrance of the wire guide 90.

A plurality of reinforcing ribs 532 may be formed at the wire restrictor 53 in an extending direction of the wire restrictor 53. Therefore, even if a load is applied while the wire restrictor 53 presses and fixes the wire L, the wire restrictor 53 may be prevented from being damaged or deformed.

Hereinafter, an assembling process of the indoor device having the above-described structure will be described.

Figure 21:
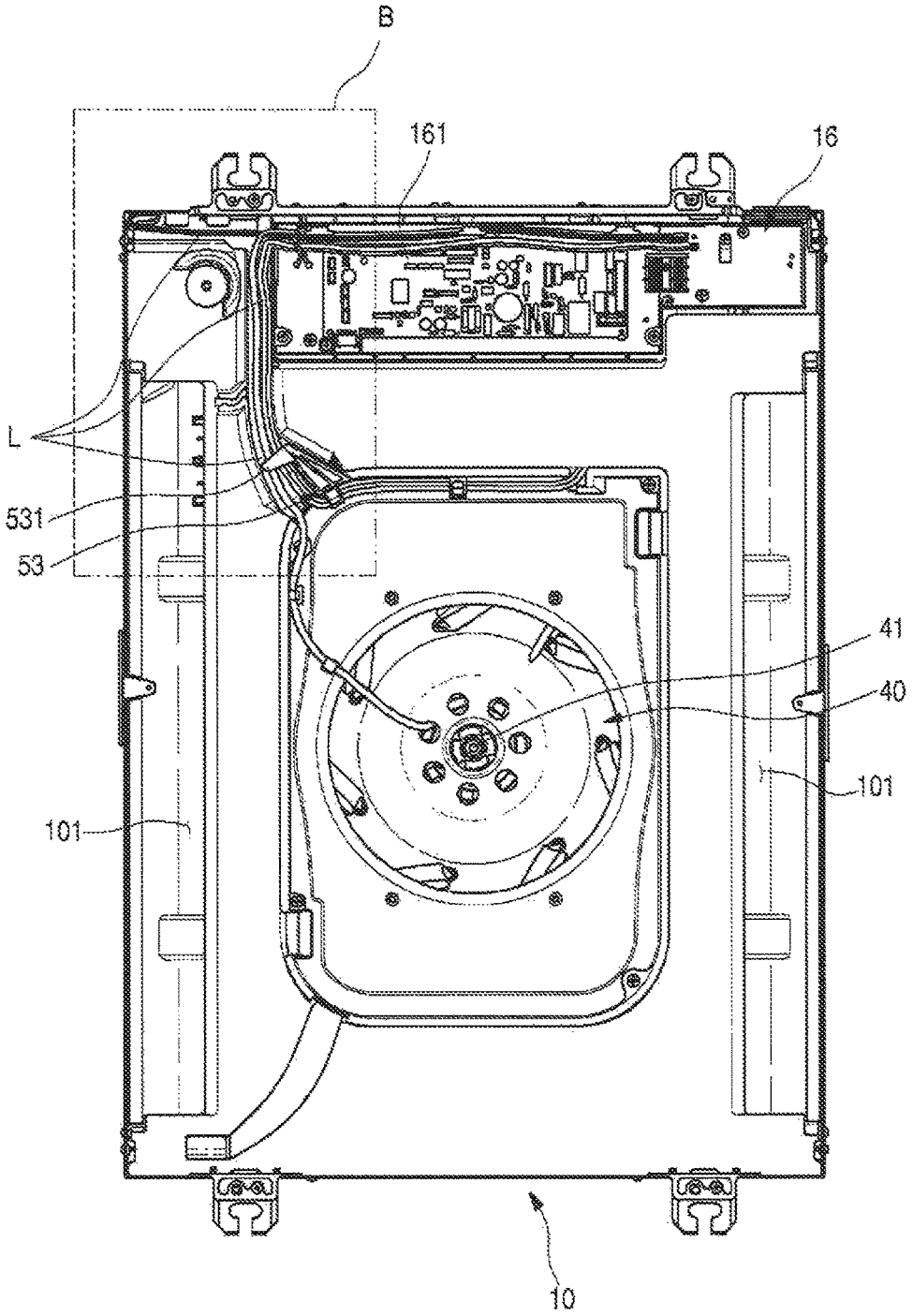
FIG. 21 is a plan view illustrating a wire arrangement state inside of the cabinet according to an embodiment.
Figure 22:
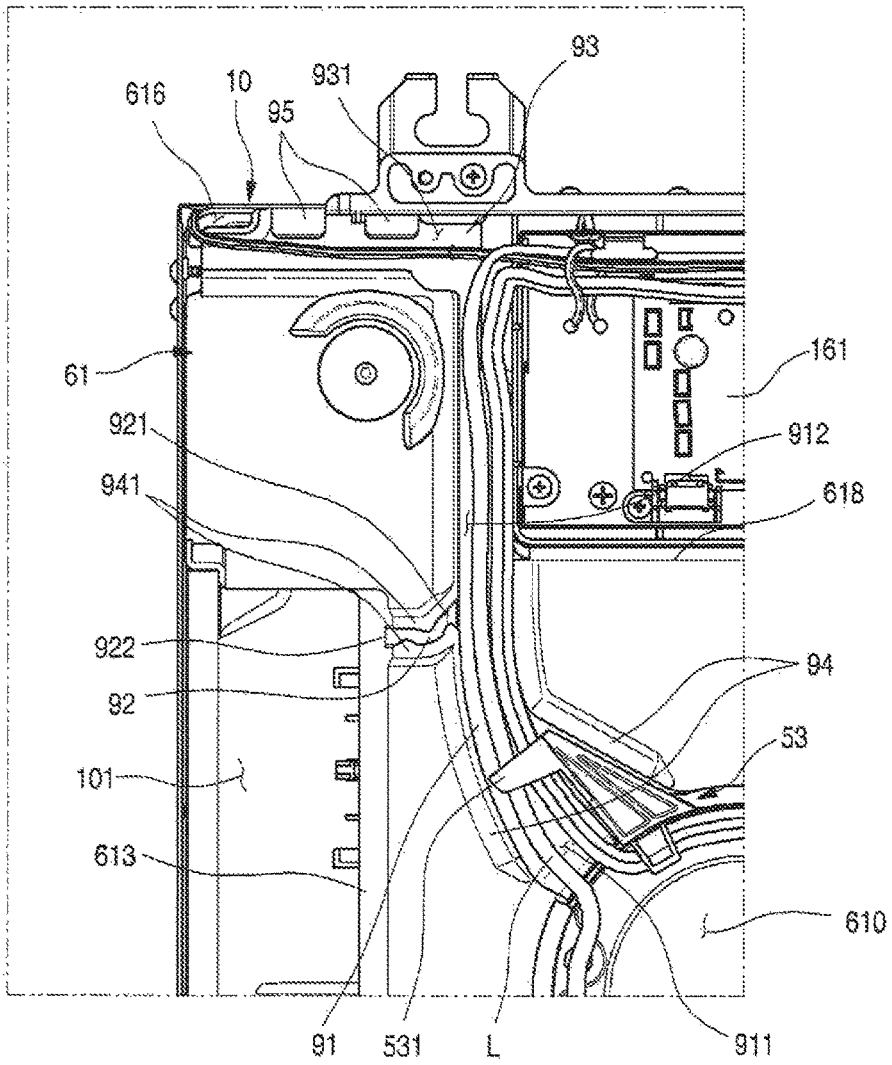
FIG. 22 is an enlarged view of a portion B of FIG. 21.

FIG. 21 is a plan view illustrating a wire arrangement state inside of the cabinet according to an embodiment. FIG. 22 is an enlarged view of a portion B of FIG. 21.

First, the inner case 12 may be installed inside of the outer plate 11, which forms the exterior, and the fan 40, the fan motor (not shown), the heat exchanger 30, the condensate pump 70, and the control box 16, for example, may be installed inside of the inner case 12. In a state in which all internal elements of the cabinet 10 are arranged, the drain pan assembly 60 may be installed. The drain pan assembly 60 may be seated on the upper end of the inner case 12. The drain pan assembly 60 may be in a state in which the pan plate 62 and the air guide 50 are coupled to the body 61.

Before or after the drain pan assembly 60 is installed, a worker may connect the control box 16 with the electronic components. For example, the wire L, which is connected to the fan motor 41 that rotates the fan 40, may be press-fitted to the wire fixing portion 514 close to the orifice hole 511, and may be guided toward the wire guide 90 along the perimeter surface 52 of the air guide 50 by the wire holder 515. The wire L, which is connected to a valve connected to the heat exchanger 30 or the temperature sensor, may be introduced inside of the air guide 50 through the wire exit 522 of the air guide 50, and may be guided to the wire guide 90 along the perimeter surface 52 of the air guide 50 by the wire holder 515.

The wires L introduced into the wire guide 90 may be guided along the wire guide 90, and then may be connected to a PCB 161 inside of the control box 16. The wire restrictor 53 may press and fix the wire L from the upper side of the wire guide 90. Therefore, the wire L may be fixed and may not escape to an outside of the wire guide 90 due to vibration.

The wire L, which is connected to the vane motor connected to the vane 23 or the temperature sensor, may pass through the recess 612, may be guided to the inside of the wire guide 90 by the first branch 92, and then may be connected to the control box 16. The wire L connected to the condensate pump 70 may pass through the pump hole 616, may be guided to the inside of the wire guide 90 by the second branch 93, and then may be connected to the control box 16. The electronic components inside of the indoor device 1 may be directed toward the control box 16 through the wire guide 90, and may be connected to the PCB 161 inside of the control box 16, and thus, an operation thereof may be controlled.

When electric power is applied, the operation of the indoor device 1 may start, and the fan 40 may be rotated by the driving of the fan motor (not shown). The air in the indoor space may be suctioned toward the center of the fan 40 through the suction grille 21 by the rotation of the fan 40, and the suctioned air may be discharged while being rotated in the circumferential direction of the fan 40, exchange heat while passing through the heat exchanger 30, and then be discharged into the indoor space through the panel outlet port 22.

Embodiments disclosed herein having the above-described configuration many have at least the following advantages.

First, the wire guide, which enables the wire to be guided toward the control box, may be formed at the upper surface of the drain pan assembly. The wire guide may enable the wire disposed or provided toward the body opening, the recess, and the pump hole to be easily provided, and thus, assemblability may be enhanced. Second, the wire fixing member may be provided at one side of the air guide to press and fix the wire disposed or provided along the wire guide from the upper side thereof. In particular, the wire guide may be integrally formed with the air guide, and thus, may naturally press and fix the wire when the air guide is installed.

Third, the wire may be maintained in a fixed state by the wire guide, the wire holder, and the wire fixing portion, which may be provided at the air guide, and vibration and noise due to shaking of the wire during operation of the indoor device may be prevented. The wire may also be prevented from escaping or deviating from its original location.

Embodiments disclosed herein are directed to providing an indoor unit or device of an air conditioner, which is able to prevent a joining portion exposed toward a panel outlet port from being generated, to reduce noise and vibration when air is discharged, and also to enhance a strength of a drain pan assembly. Embodiments disclosed herein are further directed to providing an indoor unit or device of an air conditioner, which provides a support structure of a condensate pump provided at a passage inside of a cabinet, also reduces a passage resistance inside of the cabinet, and thus, is able to increase a flow rate and reduce noise. Embodiments disclosed herein are also directed to providing an indoor unit or device of an air conditioner, which is able to simplify an arrangement of a wire for connecting a control box with electronic components provided inside of the indoor device, and to prevent noise due to movement of the wire.

Embodiments disclosed herein provide an indoor unit or device of an air conditioner that may include an outer plate configured to form an exterior of a cabinet configured to be installed at a ceiling of an indoor space; an inner case accommodated inside of the outer plate, and configured to form an internal space of the cabinet; a fan provided inside of the inner case; a heat exchanger disposed or provided to cover an outer side of the fan; a panel configured to shield the cabinet, and having an inlet port through which indoor air may be suctioned in and a panel outlet port through which heat-exchanged air may be discharged; and a drain pan assembly seated on an upper end of the inner case, and configured to collect condensate generated from the heat exchanger. An extending portion or extension that extends to an open end of the outer plate may be formed at a side surface of the inner case corresponding to the panel outlet port, and a recessed portion or recess, which is recessed in a shape corresponding to the panel outlet port, may be formed at an outer end of the drain pan assembly. Both ends of the extending portion may be in contact with an inner side surface of the recessed portion, and form an outlet port which is in communication with the panel outlet port.

A stepped portion or step which may be formed to be stepped in or to a height lower than an upper end of the extending portion, may be formed at both ends of the inner case. A seating portion or seat that protrudes in a shape corresponding to the stepped portion may be formed at both sides of the recessed portion. The stepped portion and the seating portion may be matched with each other when the drain pan assembly is installed. Both side ends of the extending portion and the inner side surface of the recessed portion may have inclined surfaces corresponding to each other, and may be slidingly in close contact with each other when the drain pan assembly is installed.

An extending portion groove or extension groove, which is recessed, may be formed at an upper end of the extending portion, and a restriction piece or restrictor, which is bent inside the extending portion groove and restricts the inner case, may be further formed at an upper end of the outer plate.

One pair of stepped portions or steps, which are stepped at both sides of the extending portion to be lower than a height of the extending portion, may be formed at the upper end of the inner case. The pair of stepped portions may be formed so that widths thereof are different from each other.

The indoor unit may further include a condensate pump, which may be installed or provided at the inner case to suction and discharge the condensate collected in the drain pan assembly; and a mounting portion or mount that protrudes from an inner side surface of the inner case and at which the condensate pump is installed. A protruding thickness of the mounting portion, which protrudes along an inner corner of the inner case, may be smaller than a width of a lower surface of the condensate pump. The mounting portion may be integrally formed with the inner case formed of an insulating material.

A supporter that connects both sides of the mounting portion extending in directions that cross each other, and to which the condensate pump may be installed and fixed, may be coupled and installed to an upper surface of the mounting portion. A mounting bracket, which may be formed of a metallic or plastic material and to which a screw passing through the supporter may be fastened, may be installed at the upper surface of the mounting portion.

A seating portion or seat that protrudes upward to be spaced apart from and support the condensate pump may be formed at the supporter. An opening may be formed at the supporter under the condensate pump.

A guide portion or guide that extends downward, in contact with a side surface of the mounting portion, and guides an installation location of the supporter may be formed at a lower surface of the supporter. While the supporter is installed, at least one of the seating portions, to which the condensate pump is fixed, may extend to an inside of the cabinet further than a corner of a protruding portion.

The indoor unit may further include a control box, which may be provided at one side of the drain pan assembly, and a wire guide portion or guide that guides an arrangement of a wire for connecting the control box with an electronic component provided inside of the cabinet may be formed to be recessed at the drain pan assembly. The wire guide portion may be connected to a body opening into which air may be introduced through the drain pan assembly.

The wire guide portion may include a main guide portion or guide that connects the body opening with the control box, a first branch portion or branch, which may be connected from the main guide portion to a recessed portion or recess of a drain pan assembly corresponding to the panel outlet port, and a second branch portion or branch, which may be connected from an end of the main guide portion to a pump hole in communication with a space in which the condensate pump inside of the cabinet may be accommodated.

The drain pan assembly may include an air guide, which may be installed or provided at the drain pan assembly and form an orifice hole through which air may be suctioned toward the fan, and a wire restricting member or restrictor that extends to cross an upper side of the wire guide portion and restrict the wire may be formed at the air guide. The wire restricting member may extend along the wire guide portion, and a restricting portion or restrictor that extends to cross the wire guide portion may be formed at an extended end. A reinforcing rib, which may be formed in an extending direction of the wire restricting member to reinforce a strength thereof, may be further formed at the wire restricting member.

A wire restricting portion or restrictor, in which a wire guided toward a guide portion may be press-fitted and restricted, may be formed at the air guide. A wire holder that fixes a wire guided toward the wire guide portion to be in close contact with a perimeter surface of the air guide may be formed at a perimeter of the air guide.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device of an air conditioner, comprising:

an outer plate configured to form an exterior of a cabinet configured to be installed at a ceiling of an indoor space;

an inner case accommodated inside of the outer plate, and configured to form an internal space of the cabinet;

a fan provided inside of the inner case;

a heat exchanger that covers an outer side of the fan;

a panel configured to shield the cabinet, and having an inlet port through which indoor air is suctioned in and one or more panel outlet port through which heat-exchanged air is discharged; and a drain pan assembly seated on an end of the inner case, and configured to collect condensate generated from the heat exchanger, wherein one or more extension that extends at an open end of the outer plate is formed at a side surface of the inner case corresponding to the one or more panel outlet port, wherein one or more recess, which is recessed in a shape corresponding to the one or more panel outlet port, is formed at an outer end of the drain pan assembly, wherein both ends of the one or more extension are in contact with an inner side surface of the recess, and form an outlet port which is in communication with the one or more panel outlet port, wherein the one or more recess has a shape which is recessed in a direction perpendicular to a direction in which the one or more extension extends, and wherein the panel outlet port is formed by shielding one open side of the one or more recess by the one or more extension.

2. The indoor device according to claim 1, wherein one or more step, which is formed to be stepped at a height lower than an upper end of the one or more extension, is formed at both ends of the inner case, and a seat, which protrudes in a shape corresponding to the one or more step, is formed at both sides of the one or more recess, and the steps and the seats are mated with each other when the drain pan assembly is installed.

3. The indoor device according to claim 2, wherein both side ends of the extension and the inner side surface of the recess have inclined surfaces corresponding to each other, and are slidingly in close contact with each other when the drain pan assembly is installed.

4. The indoor device according to claim 1, wherein an extension groove, which is recessed, is formed at an upper end of the one or more extension, and a restrictor, which is bent inside the extension groove and restricts the inner case is further formed at an upper end of the outer plate.

5. The indoor device according to claim 1, wherein a pair of steps, which are stepped at both sides of the one or more extension to be lower than a height of the one or more extension is formed at the upper end of the inner case, and the pair of steps is formed so that widths thereof are different from each other.

6. The indoor device according to claim 1, further including:

a condensate pump provided in the inner case to suction and discharge the condensate collected in the drain pan assembly; and a mount that protrudes from an inner side surface of the inner case and at which the condensate pump is installed, wherein a protruding thickness of the mount, which protrudes along an inner corner of the inner case, is smaller than a width of a lower surface of the condensate pump.

7. The indoor device according to claim 6, wherein the mount is integrally formed with the inner case, which is formed of an insulating material.

8. The indoor device according to claim 6, wherein one or more supporter that connects both sides of the mount extending in directions that cross each other and to which the condensate pump is installed and fixed is coupled and installed to an upper surface of the mount.

9. The indoor device according to claim 8, wherein one or more mounting bracket, which is formed of a metallic or plastic material and to which a screw passing through the supporter is fastened, is installed at the upper surface of the mount.

10. The indoor device according to claim 8, wherein one or more guide that extends downward, is in contact with a side surface of the mount, and guides an installation location of the supporter is formed at a lower surface of the supporter.

11. The indoor device according to claim 8, wherein one or more seat that protrudes upward to be spaced apart from and support the condensate pump is formed at the supporter, and an opening is formed at the supporter under the condensate pump.

12. The indoor device according to claim 11, wherein, when the supporter is installed, at least one of the one or more seats to which the condensate pump is fixed extends to an inside of the cabinet further than a corner of a protrusion.

13. The indoor device according to claim 1, further including:

a control box provided at one side of the drain pan assembly, wherein one or more wire guide that guides an arrangement of one or more wire that connects the control box with one or more electronic component provided inside of the cabinet is formed recessed at the drain pan assembly.

14. The indoor device according to claim 13, wherein the one or more wire guide is connected to a body opening into which air is introduced through the drain pan assembly.

15. The indoor device according to claim 14, wherein the one or more wire guide includes a main guide that connects the body opening with the control box, a first branch connected from the main guide to a recess of the drain pan assembly corresponding to the panel outlet port, and a second branch connected from an end of the main guide to a pump hole in communication with a space in which a condensate pump is accommodated inside of the cabinet.

16. The indoor device according to claim 14, wherein the drain pan assembly includes an air guide installed at the drain pan assembly and forming an orifice hole through which air is suctioned toward the fan, and wherein a wire restrictor that extends to cross an upper side of the one or more wire guide and restrict the one or more wire is formed at the air guide.

17. The indoor device according to claim 16, wherein the wire restrictor extends along the one or more wire guide, and a restrictor that extends to cross the one or more wire guide is formed at an extended end thereof.

18. The indoor device according to claim 16, wherein one or more reinforcing rib formed in an extending direction of the wire restrictor to reinforce a strength thereof is further formed at the wire restrictor.

19. The indoor device according to claim 16, wherein a wire restrictor in which one or more wire guided toward one or more wire guide is press-fitted and restricted is formed at the air guide.

20. The indoor device according to claim 16, wherein a wire holder that fixes one or more wire guided toward the one or more wire guide to be in close contact with a perimeter surface of the air guide is formed at a perimeter of the air guide.

* * * * *